US010456659B2

(12) United States Patent
Krenn et al.

(10) Patent No.: US 10,456,659 B2
(45) **Date of Patent: *Oct. 29, 2019**

(54) CARD HANDLING DEVICES AND SYSTEMS

(71) Applicant: Shuffle Master GmbH & Co KG., Vienna (AT)

(72) Inventors: Peter Krenn, Neufeld (AT); Ernst Blaha, Tullnerback (AT); Attila Grauzer, Las Vegas, NV (US)

(73) Assignee: Shuffle Master GmbH & Co KG, Vienna (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/846,525

(22) Filed: Sep. 4, 2015

(65) Prior Publication Data

US 2015/0375094 A1 Dec. 31, 2015
US 2016/0375350 A9 Dec. 29, 2016

Related U.S. Application Data

(63) Continuation of application No. 14/090,730, filed on Nov. 26, 2013, now Pat. No. 9,126,103, which is a continuation of application No. 13/204,988, filed on Aug. 8, 2011, now Pat. No. 8,590,896, which is a continuation-in-part of application No. 12/321,318, filed on Jan. 16, 2009, now Pat. No. 8,511,684, which is a continuation-in-part of application No. 12/291,909, filed on Nov. 14, 2008, now Pat. No. 8,490,973, which is a continuation-in-part of (Continued)

(51) Int. Cl.
*A63F 1/12* (2006.01)
*A63F 1/14* (2006.01)

(52) U.S. Cl.
CPC . *A63F 1/12* (2013.01); *A63F 1/14* (2013.01)

(58) Field of Classification Search
CPC ..... A63F 1/12; A63F 1/14; A63F 1/18
See application file for complete search history.

(56) References Cited

U.S. PATENT DOCUMENTS 1,130,281 A 8/1872 Coughlin
2,205,030 A 6/1878 Ash
609,730 A 8/1898 Booth (Continued)

FOREIGN PATENT DOCUMENTS

AU 5025479 A 3/1980
AU 757636 B2 2/2003

(Continued)

OTHER PUBLICATIONS

VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.

(Continued)

*Primary Examiner* — Peter C English
(74) *Attorney, Agent, or Firm* — TraskBritt

(57) ABSTRACT

Automatic card shufflers include a card shuffling mechanism, a base at least partially supporting the card shuffling mechanism, a shoe to receive cards from the card shuffling mechanism, and a card imaging system configured to detect at least one indicia on the cards, the card imaging system being at least partially disposed within the base.

20 Claims, 18 Drawing Sheets

Related U.S. Application Data application No. 12/287,979, filed on Oct. 14, 2008, now abandoned.

(56) References Cited

U.S. PATENT DOCUMENTS

| | | | |
|---|---|---|---|
| 673,154 | A | 4/1901 | Bellows |
| 793,489 | A | 6/1905 | Williams |
| 892,389 | A | 7/1908 | Bellows |
| 1,014,219 | A | 1/1912 | Hall |
| 1,043,109 | A | 11/1912 | Hurm |
| 1,157,898 | A | 10/1915 | Perret |
| 1,256,509 | A | 2/1918 | Belknap |
| 1,380,898 | A | 6/1921 | Hall |
| 1,556,856 | A | 10/1925 | Lipps |
| 1,850,114 | A | 3/1932 | McCaddin |
| 1,885,276 | A | 11/1932 | McKay |
| 1,955,926 | A | 4/1934 | Matthaey |
| 1,992,085 | A | 2/1935 | McKay |
| 1,998,690 | A | 4/1935 | Hartridge et al. |
| 2,001,220 | A | 5/1935 | Smith |
| 2,001,918 | A | 5/1935 | Nevius |
| 2,016,030 | A | 10/1935 | Rose |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,328,153 | A | 8/1943 | Laing |
| 2,328,879 | A | 9/1943 | Isaacson |
| 2,364,413 | A | 12/1944 | Wittel |
| 2,525,305 | A | 10/1950 | Eugene |
| 2,543,522 | A | 2/1951 | Cohen |
| 2,588,582 | A | 3/1952 | Sivertson |
| 2,615,719 | A | 10/1952 | Fonken |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Howard |
| 2,755,090 | A | 7/1956 | Aldrich |
| 2,757,005 | A | 7/1956 | Nothaft |
| 2,760,779 | A | 8/1956 | Ogden et al. |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,914,215 | A | 11/1959 | Neidig |
| 2,937,739 | A | 5/1960 | Moise |
| 2,950,005 | A | 8/1960 | MacDonald |
| RE24,986 | E | 5/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Gronneberg |
| 3,147,978 | A | 9/1964 | Sjostrand |
| 3,222,071 | A | 12/1965 | Lang |
| 3,235,741 | A | 2/1966 | Plaisance |
| 3,288,308 | A | 11/1966 | Gingher |
| 3,305,237 | A | 2/1967 | Granius |
| 3,312,473 | A | 4/1967 | Friedman et al. |
| 3,452,509 | A | 7/1969 | Hauer |
| 3,530,968 | A | 9/1970 | Palmer |
| 3,588,116 | A | 6/1971 | Miura |
| 3,589,730 | A | 6/1971 | Slay |
| 3,595,388 | A | 7/1971 | Castaldi |
| 3,597,076 | A | 8/1971 | Hubbard |
| 3,598,396 | A | 8/1971 | Andrews et al. |
| 3,618,933 | A | 11/1971 | Roggenstein |
| 3,627,331 | A | 12/1971 | Erickson |
| 3,666,270 | A | 5/1972 | Mazur |
| 3,680,853 | A | 8/1972 | Houghton |
| 3,690,670 | A | 9/1972 | Cassady et al. |
| 3,704,938 | A | 12/1972 | Fanselow |
| 3,716,238 | A | 2/1973 | Porter |
| 3,751,041 | A | 8/1973 | Seifert |
| 3,761,079 | A | 9/1973 | Azure |
| 3,810,627 | A | 5/1974 | Levy |
| 3,861,261 | A | 1/1975 | Maxey |
| 3,897,954 | A | 8/1975 | Erickson et al. |
| 3,909,002 | A | 9/1975 | Levy |
| 3,929,339 | A | 12/1975 | Mattioli et al. |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski et al. |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Noguchi et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette |
| 4,339,134 | A | 7/1982 | MacHeel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Soda et al. |
| 4,397,469 | A | 8/1983 | Carter |
| 4,421,312 | A | 12/1983 | Delgado et al. |
| 4,421,501 | A | 12/1983 | Scheffer |
| D274,069 | S | 5/1984 | Fromm |
| 4,467,424 | A | 8/1984 | Hedges et al. |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel |
| 4,515,367 | A | 5/1985 | Howard |
| 4,531,187 | A | 7/1985 | Uhland et al. |
| 4,534,562 | A | 8/1985 | Cuff et al. |
| 4,549,738 | A | 10/1985 | Greitzer |
| 4,566,782 | A | 1/1986 | Britt et al. |
| 4,575,367 | A | 3/1986 | Karmel |
| 4,586,712 | A | 5/1986 | Lorber et al. |
| 4,659,082 | A | 4/1987 | Greenberg |
| 4,662,637 | A | 5/1987 | Pfeiffer et al. |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak |
| 4,858,000 | A | 8/1989 | Lu |
| 4,861,041 | A | 8/1989 | Jones et al. |
| 4,876,000 | A | 10/1989 | Mikhail |
| 4,900,009 | A | 2/1990 | Kitahara et al. |
| 4,904,830 | A | 2/1990 | Rizzuto |
| 4,921,109 | A | 5/1990 | Hasuo et al. |
| 4,926,327 | A | 5/1990 | Sidley |

(56) References Cited

U.S. PATENT DOCUMENTS 4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng et al.
5,000,453 A 3/1991 Stevens et al.
5,039,102 A 8/1991 Miller et al.
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci et al.
5,121,192 A 6/1992 Kazui
5,121,921 A 6/1992 Friedman
5,154,429 A 10/1992 Levasseur et al.
5,179,517 A 1/1993 Sarbin et al.
5,197,094 A 3/1993 Tillery et al.
5,199,710 A 4/1993 Lamle
5,209,476 A 5/1993 Eiba et al.
5,224,712 A 7/1993 Laughlin et al.
5,240,140 A 8/1993 Huen
5,248,142 A 9/1993 Breeding et al.
5,257,179 A 10/1993 Demar et al.
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding et al.
5,299,089 A 3/1994 Lwee et al.
5,303,921 A 4/1994 Breeding
5,344,146 A 9/1994 Lee
5,356,145 A * 10/1994 Verschoor ..... A63F 1/12 273/149 R
5,362,053 A 11/1994 Miller et al.
5,374,061 A 12/1994 Albrecht et al.
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias et al.
5,416,308 A 5/1995 Hood et al.
5,431,399 A 7/1995 Kelley et al.
5,431,407 A 7/1995 Hofberg et al.
5,437,462 A 8/1995 Breeding et al.
5,445,377 A 8/1995 Steinbach
5,470,079 A 11/1995 LeStrange et al.
D365,853 S 1/1996 Zadro
5,489,101 A 2/1996 Moody et al.
5,515,477 A 5/1996 Sutherland
5,524,888 A 6/1996 Heidel
5,531,448 A 7/1996 Moody et al.
5,544,892 A 8/1996 Breeding et al.
5,575,475 A 11/1996 Steinbach
5,584,483 A 12/1996 Sines et al.
5,586,766 A 12/1996 Forte et al.
5,586,936 A 12/1996 Bennett et al.
5,605,334 A * 2/1997 McCrea, Jr. ..... A63F 1/14 273/309
5,613,912 A 3/1997 Slater et al.
5,632,483 A 5/1997 Garczynski et al.
5,636,843 A 6/1997 Roberts et al.
5,651,548 A 7/1997 French et al.
5,655,961 A 8/1997 Acres et al.
5,655,966 A 8/1997 Werdin, Jr. et al.
5,669,816 A 9/1997 Garczynski et al.
5,676,231 A 10/1997 Legras et al.
5,676,372 A 10/1997 Sines et al.
5,681,039 A 10/1997 Miller et al.
5,683,085 A 11/1997 Johnson et al.
5,685,543 A 11/1997 Garner et al.
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea et al.
5,711,525 A 1/1998 Breeding et al.
5,718,427 A 2/1998 Cranford et al.
5,719,288 A 2/1998 Sens et al.
5,720,484 A 2/1998 Hsu et al.
5,722,893 A 3/1998 Hill et al.
5,735,525 A 4/1998 McCrea et al.
5,735,724 A 4/1998 Udagawa
5,735,742 A 4/1998 French et al.
5,743,798 A 4/1998 Adams et al.
5,768,382 A 6/1998 Schneier et al.
5,770,533 A 6/1998 Franchi et al.
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 Van Putten et al.
5,788,574 A 8/1998 Ornstein et al.
5,791,988 A 8/1998 Nomi et al.
5,802,560 A 9/1998 Joseph et al.
5,803,808 A 9/1998 Strisower
5,810,355 A 9/1998 Trilli
5,813,326 A 9/1998 Salomon et al.
5,813,912 A 9/1998 Shultz et al.
5,814,796 A 9/1998 Benson et al.
5,836,775 A 11/1998 Hiyama et al.
5,839,730 A 11/1998 Pike
5,845,906 A 12/1998 Wirth et al.
5,851,011 A 12/1998 Lott et al.
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea et al.
5,919,090 A 7/1999 Mothwurf
5,936,222 A 8/1999 Korsunsky et al.
5,941,769 A 8/1999 Order
5,944,310 A 8/1999 Johnson et al.
D414,527 S 9/1999 Tedham
5,957,776 A 9/1999 Hoehne et al.
5,974,150 A 10/1999 Kaish et al.
5,985,305 A 11/1999 Peery et al.
5,989,122 A 11/1999 Roblejo et al.
5,991,308 A 11/1999 Fuhrmann et al.
6,015,311 A 1/2000 Benjamin et al.
6,019,368 A 2/2000 Sines et al.
6,019,374 A 2/2000 Breeding et al.
6,039,650 A 3/2000 Hill et al.
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea et al.
6,113,101 A 9/2000 Wirth et al.
6,117,012 A 9/2000 McCrea et al.
D432,588 S 10/2000 Tedham
6,126,166 A 10/2000 Lorson et al.
6,127,447 A 10/2000 Mitry et al.
6,131,817 A 10/2000 Miller
6,139,014 A 10/2000 Breeding et al.
6,149,154 A 11/2000 Grauzer et al.
6,154,131 A 11/2000 Jones et al.
6,165,069 A 12/2000 Sines et al.
6,165,072 A 12/2000 Davis et al.
6,183,362 B1 2/2001 Boushy
6,186,895 B1 2/2001 Oliver
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers

(56) References Cited

U.S. PATENT DOCUMENTS 6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block et al.
6,386,973 B1 5/2002 Yoseloff
6,402,142 B1 6/2002 Warren et al.
6,403,908 B2 6/2002 Stardust et al.
6,443,839 B2 9/2002 Stockdale et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,568,678 B2 5/2003 Breeding et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hartl
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,655,690 B1 12/2003 Oskwarek
6,658,135 B1 12/2003 Morito et al.
6,659,460 B2 12/2003 Blaha et al.
6,659,461 B2 12/2003 Yoseloff et al.
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 1/2004 Johnson et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Hessing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano, Jr. et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow
6,842,263 B1 1/2005 Saeki
6,843,725 B2 1/2005 Nelson
6,848,616 B2 2/2005 Tsirline et al.
6,848,844 B2 2/2005 McCue, Jr. et al.
6,848,994 B1 2/2005 Knust et al.
6,857,961 B2 2/2005 Soltys et al.
6,874,784 B1 4/2005 Promutico
6,874,786 B2 4/2005 Bruno
6,877,657 B2 4/2005 Ranard et al.
6,877,748 B1 4/2005 Patroni
6,886,829 B2 5/2005 Hessing et al.
6,889,979 B2 5/2005 Blaha et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow
6,938,900 B2 9/2005 Snow
6,941,180 B1 9/2005 Fischer et al.
6,950,948 B2 9/2005 Neff
6,955,599 B2 10/2005 Bourbour et al.
6,957,746 B2 10/2005 Martin et al.
6,959,925 B1 11/2005 Baker et al.
6,959,935 B2 11/2005 Buhl et al.
6,960,134 B2 11/2005 Hartl et al.
6,964,612 B2 11/2005 Soltys et al.
6,986,514 B2 1/2006 Snow
6,988,516 B2 1/2006 Debaes et al.
7,011,309 B2 3/2006 Soltys et al.
7,020,307 B2 3/2006 Hinton et al.
7,028,598 B2 4/2006 Teshima
7,029,009 B2 4/2006 Grauzer et al.
7,036,818 B2 5/2006 Grauzer et al.
7,046,458 B2 5/2006 Nakayama

(56) References Cited

U.S. PATENT DOCUMENTS

| | | | |
|---|---|---|---|
| 7,046,764 | B1 | 5/2006 | Kump |
| 7,048,629 | B2 | 5/2006 | Sines et al. |
| 7,059,602 | B2 | 6/2006 | Grauzer et al. |
| 7,066,464 | B2 | 6/2006 | Blad et al. |
| 7,068,822 | B2 | 6/2006 | Scott |
| 7,073,791 | B2 | 7/2006 | Grauzer et al. |
| 7,084,769 | B2 | 8/2006 | Bauer et al. |
| 7,089,420 | B1 | 8/2006 | Durst et al. |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,124,947 | B2 | 10/2006 | Storch |
| 7,128,652 | B1 | 10/2006 | Lavoie et al. |
| 7,137,627 | B2 | 11/2006 | Grauzer et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,213,812 | B2 | 5/2007 | Schubert et al. |
| 7,222,852 | B2 | 5/2007 | Soltys et al. |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,344 | B2 | 8/2007 | Grauzer et al. |
| 7,255,351 | B2 | 8/2007 | Yoseloff et al. |
| 7,255,642 | B2 | 8/2007 | Sines et al. |
| 7,257,630 | B2 | 8/2007 | Cole et al. |
| 7,261,294 | B2 | 8/2007 | Grauzer et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,309,065 | B2 | 12/2007 | Yoseloff et al. |
| 7,316,609 | B2 | 1/2008 | Dunn et al. |
| 7,316,615 | B2 | 1/2008 | Soltys et al. |
| 7,322,576 | B2 | 1/2008 | Grauzer et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| 7,357,321 | B2 | 4/2008 | Yoshida et al. |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,884 | B2 | 5/2008 | Breeding et al. |
| 7,374,170 | B2 | 5/2008 | Grauzer et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,390,256 | B2 | 6/2008 | Soltys et al. |
| 7,399,226 | B2 | 7/2008 | Mishra |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,436,957 | B1 | 10/2008 | Fischer et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,537,216 | B2 | 5/2009 | Soltys et al. |
| 7,540,497 | B2 | 6/2009 | Tseng |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida et al. |
| 7,556,266 | B2 | 7/2009 | Blaha et al. |
| 7,575,237 | B2 | 8/2009 | Snow |
| 7,578,506 | B2 | 8/2009 | Lambert |
| 7,584,962 | B2 | 9/2009 | Breeding et al. |
| 7,584,963 | B2 | 9/2009 | Krenn et al. |
| 7,584,966 | B2 | 9/2009 | Snow |
| 7,591,728 | B2 | 9/2009 | Gioia et al. |
| 7,593,544 | B2 | 9/2009 | Downs, III et al. |
| 7,594,660 | B2 | 9/2009 | Baker et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,852 | B2 | 3/2010 | Baker et al. |
| 7,669,853 | B2 | 3/2010 | Jones |
| 7,677,565 | B2 | 3/2010 | Grauzer et al. |
| 7,677,566 | B2 | 3/2010 | Krenn et al. |
| 7,686,681 | B2 | 3/2010 | Soltys et al. |
| 7,699,694 | B2 | 4/2010 | Hill |
| 7,735,657 | B2 | 6/2010 | Johnson |
| 7,740,244 | B2 | 6/2010 | Ho |
| 7,744,452 | B2 | 6/2010 | Cimring et al. |
| 7,753,373 | B2 | 7/2010 | Grauzer et al. |
| 7,753,374 | B2 | 7/2010 | Ho |
| 7,753,798 | B2 | 7/2010 | Soltys et al. |
| 7,762,554 | B2 | 7/2010 | Ho |
| 7,764,836 | B2 | 7/2010 | Downs, III et al. |
| 7,766,332 | B2 | 8/2010 | Grauzer et al. |
| 7,766,333 | B1 | 8/2010 | Stardust et al. |
| 7,769,232 | B2 | 8/2010 | Downs, III |
| 7,769,853 | B2 | 8/2010 | Nezamzadeh |
| 7,773,749 | B1 | 8/2010 | Durst et al. |
| 7,780,529 | B2 | 8/2010 | Rowe et al. |
| 7,784,790 | B2 | 8/2010 | Grauzer et al. |
| 7,804,982 | B2 | 9/2010 | Howard et al. |
| 7,846,020 | B2 | 12/2010 | Walker et al. |
| 7,867,080 | B2 | 1/2011 | Nicely et al. |
| 7,890,365 | B2 | 2/2011 | Hettinger |
| 7,900,923 | B2 | 3/2011 | Toyama et al. |
| 7,901,285 | B2 | 3/2011 | Tran et al. |
| 7,908,169 | B2 | 3/2011 | Hettinger |
| 7,909,689 | B2 | 3/2011 | Lardie |
| 7,931,533 | B2 | 4/2011 | LeMay et al. |
| 7,933,448 | B2 | 4/2011 | Downs, III |
| 7,946,586 | B2 | 5/2011 | Krenn et al. |
| 7,959,153 | B2 | 6/2011 | Franks, Jr. |
| 7,967,294 | B2 | 6/2011 | Blaha et al. |
| 7,976,023 | B1 | 7/2011 | Hessing et al. |
| 7,988,152 | B2 | 8/2011 | Sines |
| 7,988,554 | B2 | 8/2011 | LeMay et al. |
| 8,002,638 | B2 | 8/2011 | Grauzer et al. |
| 8,011,661 | B2 | 9/2011 | Stasson |
| 8,016,663 | B2 | 9/2011 | Soltys et al. |
| 8,021,231 | B2 | 9/2011 | Walker et al. |
| 8,025,294 | B2 | 9/2011 | Grauzer et al. |
| 8,038,521 | B2 | 10/2011 | Grauzer et al. |
| RE42,944 | E | 11/2011 | Blaha et al. |
| 8,057,302 | B2 | 11/2011 | Wells et al. |
| 8,062,134 | B2 | 11/2011 | Kelly et al. |
| 8,070,574 | B2 | 12/2011 | Grauzer et al. |

(56) References Cited

U.S. PATENT DOCUMENTS 8,092,307 B2 1/2012 Kelly
8,092,309 B2 1/2012 Bickley
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 1/2013 Scheper et al.
8,342,526 B1 1/2013 Sampson et al.
8,342,529 B2 1/2013 Snow
8,353,513 B2 1/2013 Swanson
8,381,918 B2 2/2013 Johnson
8,419,521 B2 4/2013 Grauzer et al.
8,444,147 B2 5/2013 Grauzer et al.
8,469,360 B2 6/2013 Sines
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,556,263 B2 10/2013 Grauzer et al.
8,579,289 B2 11/2013 Rynda et al.
8,616,552 B2 12/2013 Czyzewski et al.
8,628,086 B2 1/2014 Krenn et al.
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,899,587 B2 12/2014 Grauzer et al.
8,919,775 B2 12/2014 Wadds et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,679,603 B2 6/2017 Kelly et al.
9,731,190 B2 8/2017 Sampson et al.
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0030425 A1 3/2002 Tiramani et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Globbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0047870 A1* 3/2003 Blaha et al. ..... A63F 1/12 273/149 R
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0023752 A1 2/2005 Grauzer et al.
2005/0026680 A1 2/2005 Gururajan
2005/0035548 A1 2/2005 Yoseloff et al.
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.
2005/0113166 A1 5/2005 Grauzer et al.
2005/0113171 A1 5/2005 Hodgson
2005/0119048 A1 6/2005 Soltys et al.
2005/0121852 A1* 6/2005 Soltys et al. ..... A63F 1/18 273/149 P
2005/0137005 A1 6/2005 Soltys et al.
2005/0140090 A1 6/2005 Breeding et al.
2005/0146093 A1 7/2005 Grauzer et al.
2005/0148391 A1 7/2005 Tain
2005/0164761 A1 7/2005 Tain
2005/0192092 A1 9/2005 Breckner et al.
2005/0206077 A1 9/2005 Grauzer et al.
2005/0242500 A1 11/2005 Downs
2005/0272501 A1 12/2005 Tran et al.
2005/0277463 A1 12/2005 Knust et al.
2005/0288083 A1 12/2005 Downs
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0063577 A1 3/2006 Downs et al.
2006/0066048 A1 3/2006 Krenn et al.
2006/0151946 A1 7/2006 Ngai
2006/0181022 A1 8/2006 Grauzer et al.
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1 10/2006 Baker et al.
2006/0220313 A1 10/2006 Baker et al.
2006/0252521 A1 11/2006 Gururajan et al.
2006/0252554 A1 11/2006 Gururajan et al.
2006/0279040 A1* 12/2006 Downs, III et al. ..... A63F 1/14 273/149 R
2006/0281534 A1 12/2006 Grauzer et al.
2007/0001395 A1 1/2007 Gioia et al.
2007/0006708 A1 1/2007 Laakso
2007/0015583 A1 1/2007 Tran
2007/0018389 A1 1/2007 Downs

(56) References Cited

U.S. PATENT DOCUMENTS

2007/0045959 A1 3/2007 Soltys
2007/0049368 A1 3/2007 Kuhn et al.
2007/0057454 A1 3/2007 Fleckenstein
2007/0057469 A1 3/2007 Grauzer et al.
2007/0066387 A1 3/2007 Matsuno et al.
2007/0069462 A1 3/2007 Downs et al.
2007/0072677 A1 3/2007 Lavoie et al.
2007/0102879 A1 5/2007 Stasson
2007/0111773 A1 5/2007 Gururajan et al.
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0222147 A1 9/2007 Blaha et al.
2007/0225055 A1 9/2007 Weisman
2007/0233567 A1 10/2007 Daly
2007/0238506 A1 10/2007 Ruckle
2007/0241498 A1 10/2007 Soltys
2007/0259709 A1 11/2007 Kelly et al.
2007/0267812 A1 11/2007 Grauzer et al.
2007/0272600 A1 11/2007 Johnson
2007/0278739 A1 12/2007 Swanson
2007/0287534 A1 12/2007 Fleckenstein
2007/0290438 A1 12/2007 Grauzer et al.
2007/0298865 A1 12/2007 Soltys
2008/0004107 A1 1/2008 Nguyen et al.
2008/0006997 A1 1/2008 Scheper et al.
2008/0006998 A1 1/2008 Grauzer et al.
2008/0022415 A1 1/2008 Kuo et al.
2008/0032763 A1 2/2008 Giobbi
2008/0039192 A1 2/2008 Laut
2008/0039208 A1 2/2008 Abrink et al.
2008/0096656 A1 4/2008 LeMay et al.
2008/0111300 A1 5/2008 Czyzewski et al.
2008/0113700 A1 5/2008 Czyzewski et al.
2008/0113783 A1 5/2008 Czyzewski et al.
2008/0136108 A1 6/2008 Polay
2008/0143048 A1 6/2008 Shigeta
2008/0176627 A1 7/2008 Lardie
2008/0217218 A1 9/2008 Johnson
2008/0234046 A1 9/2008 Kinsley
2008/0234047 A1 9/2008 Nguyen
2008/0248875 A1 10/2008 Beatty
2008/0284096 A1 11/2008 Toyama et al.
2008/0303210 A1 12/2008 Grauzer et al.
2008/0315517 A1 12/2008 Toyama
2009/0026700 A2 1/2009 Shigeta
2009/0048026 A1 2/2009 French
2009/0054161 A1 2/2009 Schubert et al.
2009/0072477 A1 3/2009 Tseng
2009/0091078 A1 4/2009 Grauzer et al.
2009/0100409 A1 4/2009 Toneguzzo
2009/0104963 A1 4/2009 Burman
2009/0121429 A1 5/2009 Walsh
2009/0140492 A1 6/2009 Yoseloff et al.
2009/0166970 A1 7/2009 Rosh
2009/0176547 A1 7/2009 Katz
2009/0179378 A1 7/2009 Amaitis et al.
2009/0186676 A1 7/2009 Amaitis et al.
2009/0189346 A1* 7/2009 Krenn et al. ..... A63F 1/12 273/149 R
2009/0191933 A1 7/2009 French
2009/0194988 A1 8/2009 Wright et al.
2009/0197662 A1 8/2009 Wright et al.
2009/0224476 A1 9/2009 Grauzer et al.
2009/0227318 A1 9/2009 Wright et al.
2009/0227360 A1 9/2009 Gioia et al.
2009/0250873 A1 10/2009 Jones
2009/0253478 A1 10/2009 Walker et al.
2009/0253503 A1 10/2009 Krise et al.
2009/0267296 A1 10/2009 Ho
2009/0267297 A1 10/2009 Blaha et al.
2009/0283969 A1 11/2009 Tseng
2009/0298577 A1 12/2009 Gagner et al.
2009/0302535 A1 12/2009 Ho
2009/0302537 A1 12/2009 Ho
2009/0312093 A1 12/2009 Walker et al.
2009/0314188 A1 12/2009 Toyama et al.
2010/0013152 A1 1/2010 Grauzer et al.
2010/0038849 A1 2/2010 Scheper et al.
2010/0048304 A1 2/2010 Boesen
2010/0069155 A1 3/2010 Schwartz et al.
2010/0178987 A1 7/2010 Pacey
2010/0197410 A1 8/2010 Leen et al.
2010/0234110 A1 9/2010 Clarkson
2010/0240440 A1 9/2010 Szrek et al.
2010/0244376 A1 9/2010 Johnson
2010/0244382 A1 9/2010 Snow
2010/0252992 A1 10/2010 Sines
2010/0255899 A1 10/2010 Paulsen
2010/0276880 A1 11/2010 Grauzer et al.
2010/0311493 A1 12/2010 Miller et al.
2010/0311494 A1 12/2010 Miller et al.
2010/0314830 A1 12/2010 Grauzer et al.
2010/0320685 A1 12/2010 Grauzer et al.
2011/0006480 A1 1/2011 Grauzer et al.
2011/0012303 A1 1/2011 Kourgiantakis et al.
2011/0024981 A1 2/2011 Tseng
2011/0052049 A1 3/2011 Rajaraman et al.
2011/0062662 A1 3/2011 Ohta et al.
2011/0078096 A1 3/2011 Bounds
2011/0105208 A1 5/2011 Bickley
2011/0109042 A1 5/2011 Rynda et al.
2011/0130185 A1 6/2011 Walker
2011/0130190 A1 6/2011 Hamman et al.
2011/0159952 A1 6/2011 Kerr
2011/0159953 A1 6/2011 Kerr
2011/0165936 A1 7/2011 Kerr
2011/0172008 A1 7/2011 Alderucci
2011/0183748 A1 7/2011 Wilson et al.
2011/0230148 A1 9/2011 Demuynck et al.
2011/0230268 A1 9/2011 Williams
2011/0269529 A1 11/2011 Baerlocher
2011/0272881 A1 11/2011 Sines
2011/0285081 A1 11/2011 Stasson
2011/0287829 A1 11/2011 Clarkson et al.
2012/0015724 A1 1/2012 Ocko et al.
2012/0015725 A1 1/2012 Ocko et al.
2012/0015743 A1 1/2012 Lam et al.
2012/0015747 A1 1/2012 Ocko et al.
2012/0021835 A1 1/2012 Keller et al.
2012/0034977 A1 2/2012 Kammler
2012/0062745 A1 3/2012 Han et al.
2012/0074646 A1 3/2012 Grauzer et al.
2012/0091656 A1 4/2012 Blaha et al.
2012/0095982 A1 4/2012 Lennington et al.
2012/0161393 A1 6/2012 Krenn et al.
2012/0175841 A1 7/2012 Grauzer et al.
2012/0181747 A1 7/2012 Grauzer et al.
2012/0187625 A1 7/2012 Downs, III et al.
2012/0242782 A1 9/2012 Huang
2012/0286471 A1 11/2012 Grauzer et al.
2012/0306152 A1 12/2012 Krishnamurty et al.
2013/0020761 A1 1/2013 Sines et al.
2013/0085638 A1 4/2013 Weinmann et al.
2013/0099448 A1 4/2013 Scheper et al.
2013/0109455 A1 5/2013 Grauzer et al.
2013/0132306 A1 5/2013 Kami et al.
2013/0147116 A1 6/2013 Stasson
2013/0161905 A1 6/2013 Grauzer et al.
2013/0228972 A1 9/2013 Grauzer et al.
2013/0241147 A1 9/2013 McGrath
2013/0300059 A1 11/2013 Sampson et al.
2013/0337922 A1 12/2013 Kuhn
2014/0027979 A1 1/2014 Stasson et al.
2014/0094239 A1 4/2014 Grauzer et al.
2014/0103606 A1 4/2014 Grauzer et al.
2014/0138907 A1 5/2014 Rynda et al.
2014/0145399 A1 5/2014 Krenn et al.
2014/0171170 A1 6/2014 Krishnamurty et al.
2014/0175724 A1 6/2014 Huhtala et al.
2014/0183818 A1 7/2014 Czyzewski et al.
2015/0021242 A1 1/2015 Johnson
2015/0069699 A1 3/2015 Blazevic

(56) References Cited

U.S. PATENT DOCUMENTS

| | | | |
|---|---|---|---|
| 2015/0238848 | A1 | 8/2015 | Kuhn et al. |
| 2017/0157499 | A1 | 6/2017 | Krenn et al. |
| 2018/0200610 | A1 | 7/2018 | Riordan et al. |

FOREIGN PATENT DOCUMENTS

| | | | |
|---|---|---|---|
| CA | 2266555 | A1 | 4/1998 |
| CA | 2284017 | A1 | 2/2006 |
| CA | 2612138 | A1 | 12/2006 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 102847311 | A | 1/2013 |
| CN | 2002724641 | U | 2/2013 |
| CN | 202983149 | U | 6/2013 |
| CZ | 24952 | U1 | 2/2013 |
| DE | 0291230 | C | 4/1916 |
| DE | 672616 | C | 3/1939 |
| DE | 2816377 | A1 | 10/1979 |
| DE | 3807127 | A1 | 9/1989 |
| DE | 2757341 | A1 | 9/1998 |
| EP | 0777514 | A4 | 2/2000 |
| EP | 1502631 | A1 | 2/2005 |
| EP | 1713026 | A1 | 10/2006 |
| EP | 1194888 | A1 | 8/2009 |
| EP | 2228106 | A1 | 9/2010 |
| EP | 1575261 | B1 | 8/2012 |
| FR | 2375918 | A1 | 7/1978 |
| GB | 289552 | A | 4/1928 |
| GB | 0337147 | A | 9/1929 |
| GB | 414014 | A | 7/1934 |
| GB | 2382567 | A | 6/2003 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003-154320 | A | 5/2003 |
| JP | 2003250950 | A | 9/2003 |
| JP | 2005198668 | A | 7/2005 |
| JP | 2008246061 | A | 10/2008 |
| JP | 4586474 | B2 | 11/2010 |
| TW | M335308 | U | 7/2008 |
| TW | M357307 | U | 5/2009 |
| TW | M359356 | U | 6/2009 |
| TW | I345476 | B | 7/2011 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |
| WO | 9952611 | A1 | 10/1999 |
| WO | 200051076 | A1 | 8/2000 |
| WO | WO 0051076 | A1 * | 8/2000 ..... A63F 1/14 |
| WO | 0156670 | A1 | 8/2001 |
| WO | 0205914 | A1 | 1/2002 |
| WO | 03004116 | A1 | 1/2003 |
| WO | 2004067889 | A1 | 8/2004 |
| WO | 2004112923 | A1 | 12/2004 |
| WO | 2006031472 | A2 | 3/2006 |
| WO | 2006039308 | A2 | 4/2006 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |
| WO | 2009137541 | A2 | 11/2009 |
| WO | 2010001032 | A1 | 1/2010 |
| WO | 2010052573 | A2 | 5/2010 |
| WO | 2010055328 | A1 | 5/2010 |
| WO | 2010117446 | A1 | 10/2010 |
| WO | 2012/053074 | A1 | 4/2012 |
| WO | 2013019677 | A1 | 2/2013 |
| WO | 2016058085 | A9 | 4/2016 |

OTHER PUBLICATIONS

VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.

VendingData Corporation's Responses to Shuffle Master, Inc.'s First set of interrogatories for *Shuffle Master, Inc.* vs. *VendingData Corporation*, In the U.S. District Court, District of Nevada, No. CV-S-04-1373-JCM-LRL, Mar. 14, 2005.

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).

PCT International Search Report and Written Opinion, PCT Application No. PCT/US2015/040196, dated Jan. 15, 2016, 20 pages.

"ACE, Single Deck Shuffler," Shuffle Master, Inc., (2005), 2 pages.

"Automatic casino card shuffle," Alibaba.com, (last visited Jul. 22, 2014), 2 pages.

"Error Back propagation," http://willamette.edu~gorr/classes/cs449/backprop.html (4 pages), Nov. 13, 2008.

"I-Deal," Bally Technologies, Inc., (2014), 2 pages.

"Shufflers—SHFL entertainment," Gaming Concepts Group, (2012), 6 pages.

"TAG Archives: Shuffle Machine," Gee Wiz Online, (Mar. 25, 2013), 4 pages.

1/3" B/W CCD Camera Module EB100 by EverFocus Electronics Corp., Jul. 31, 2001, 3 pgs.

Canadian Office Action for CA 2,580,309 dated Mar. 20, 2012 (6 pages).

Christos Stergiou and Dimitrios Siganos, "Neural Networks," http://www.doc.ic.ac.uk/~nd/surprise_96/journal/vo14/cs11/report.html (13 pages), Dec. 15, 2011.

European Patent Application Search Report—European Patent Application No. 06772987.1, dated Dec. 21, 2009.

Genevieve Orr, CS-449: Neural Networks Willamette University, http://www.willamette.edu/~gorr/classes/cs449/intro.html (4 pages), Fall 1999.

http://www.google.com/search?tbm=pts&q=Card+handling+devicve+with+input+and+outpu . . . Jun. 8, 2012.

http://www.google.com/search?tbm=pts&q=shuffling+zone+onOopposite+site+of+input+ . . . Jul. 18, 2012.

Litwiller, Dave, CCD vs. CMOS: Facts and Fiction reprinted from Jan. 2001 Issue of Photonics Spectra, Laurin Publishing Co. Inc. (4 pages).

Malaysian Patent Application Substantive Examination Adverse Report—Malaysian Patent Application Serial No. PI 20062710, dated Sep. 6, 2006.

PCT International Preliminary Examination Report for corresponding International Application No. PCT/US02/31105 filed Sep. 27, 2002.

(56) References Cited

OTHER PUBLICATIONS

PCT International Preliminary Report on Patentability of the International Searching Authority for PCT/US05/31400, dated Oct. 16, 2007, 7 pages.
PCT International Search Report and Written Opinion—International Patent Application No. PCT/US2006/22911, dated Dec. 28, 2006.
PCT International Search Report and Written Opinion for International Application No. PCT/US2007/023168, dated Sep. 12, 2008, 8 pages.
PCT International Search Report and Written Opinion for International Application No. PCT/US2007/022858, dated Apr. 18, 2008, 7 pages.
PCT International Search Report and Written Opinion for PCT/US07/15036, dated Sep. 23, 2008, 3 pages.
PCT International Search Report and Written Opinion for PCT/US07/15035, dated Sep. 23, 2008, 3 pages.
PCT International Search Report and Written Opinion of the International Searching Authority for PCT/GB2011/051978, dated Jan. 17, 2012, 11 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion of the International Searching Authority for PCT/US13/59665, dated Apr. 25, 2014, 21 pages.
PCT International Search Report and Written Opinion of the International Searching Authority for PCT/US2008/007069, dated Sep. 8, 2008, 10 pages.
PCT International Search Report and Written Opinion of the International Searching Authority for PCT/US2010/001032, dated Jun. 16, 2010, 11 pages.
PCT International Search Report and Written Opinion, PCT Application No. PCT/US2013/062391, dated Dec. 17, 2013, 13 pages.
PCT International Search Report and Written Opinion, PCT/US12/48706, dated Oct. 16, 2012, 12 pages.
PCT International Search Report for International Application No. PCT/US2003/015393, dated Oct. 6, 2003.
PCT International Search Report for PCT/US2005/034737 dated Apr. 7, 2006 (WO06/039308).
PCT International Search Report for PCT/US2007/022894, dated Jun. 11, 2008, 2 pages.
PCT International Search Report and Written Opinion of the International Searching Authority for PCT/US05/31400, dated Sep. 25, 2007, 8 pages.
PCT International Search Report and Written Opinion, PCT Application No. PCT/US2015/022158, dated Jun. 17, 2015, 13 pages.
Philippines Patent Application Formality Examination Report—Philippines Patent Application No. 1-2006-000302, dated Jun. 13, 2006.
Press Release for Alliance Gaming Corp., Jul 26, 2004—Alliance Gaming Announces Control with Galaxy Macau for New MindPlay Baccarat Table Technology, http://biz.yahoo.com/prnews.
Scarne's Encyclopedia of Games by John Scarne, 1973, "Super Contract Bridge", p. 153.
Service Manual/User Manual for Single Deck Shufflers: BG1, BG2 and BG3 by Shuffle Master © 1996.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Shuffle Master's Reply Memorandum in Support of Shuffle Master's Motion for Preliminary Injunction for *Shuffle Master, Inc.* vs. *VendingData Corporation*, in the U.S. District Court, District of Nevada, No. CV-S-04-1373-JCM-LRL, Nov. 29, 2004.
Singapore Patent Application Examination Report—Singapore Patent Application No. SE 2008 01914 A, dated Aug. 6, 2006.
Specification of Australian Patent Application No. 31577/95, filed Jan. 17, 1995, Applicants: Rodney G. Johnson et al., Title: Card Handling Apparatus.
Specification of Australian Patent Application No. Not Listed, filed Aug. 15, 1994, Applicants: Rodney G. Johnson et al., Title: Card Handling Apparatus.
Statement of Relevance of Cited References, Submitted as Part of a Third-Party Submission Under 37 CFR 1.290 on Dec. 7, 2012 (12 pages).
Tbm=pts&h1=en Google Search for card handling device with storage area, card removing system pivoting arm and processor . . . ; http://www.google.com/?tbrn=pts&hl=en; Jul. 28, 2012.
Tracking the Tables, by Jack Bularsky, Casino Journal, May 2004, vol. 17, No. 5, pp. 44-47.
United States Court of Appeals for the Federal Circuit Decision Decided Dec. 27, 2005 for Preliminary Injuction for *Shuffle Master, Inc.* vs. *VendingData Corporation*, in the U.S. District Court, District of Nevada, No. CV-S-04-1373-JCM-LRL.
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2)—Divided in two parts as ShufflerArtCD1docs-Binder1-2-1 and ShufflerArtCD1docs-Binder1-2-2.
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).

(56) References Cited

OTHER PUBLICATIONS

Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in the case of *Shuffle Master, Inc*. v. *Card Austria, et al*., Case No. CV-N-0508-HDM-(VPC) (Consolidated with Case No. CV-N-02-0244-ERC-(RAM)), May 6, 2003, Part 17 of 23 (Binder 8, 5 of 5).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of color pages, for clarity, Part 19 of 23 (color copies from Binder 3).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).
Documents submitted in case of *Shuffle Master, Inc*. v. *Card Austria, et al*., Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Australian Provisional Patent Application for Australian Patent Application No. PM7441, filed Aug. 15, 1994, Applicants: Rodney G. Johnson et al., Title: Card Handling Apparatus, 13 pages.
Shuffle Master, Inc. (1996). Let It Ride, The Tournament, User Guide, 72 pages.
U.S. Appl. No. 15/276,476, filed Sep. 26, 2016, titled "Devices, Systems, and Related Methods for Real-Time Monitoring and Display of Related Data for Casino Gaming Devices", to Nagaragatta et al., 36 pages.
U.S. Appl. No. 15/365,610, filed Nov. 30, 2016, titled "Card Handling Devices and Related Assemblies and Components", to Helsen et al., 62 pages.
Weisenfeld, Bernie; Inventor betting on shatter; Courier-Post; Sep. 11, 1990; 1 page.
Solberg, Halyard; Deposition; *Shuffle Tech International* v. *Scientific Games Corp., et al*. 1:15-cv-3702 (N.D. III.); Oct. 18, 2016; pp. 187, 224-246, 326-330, 338-339, 396; Baytowne Reporting; Panama City, FL.
Prototype Glossary and Timelines; *Shuffle Tech International* v. *Scientific Games Corp., et al*. 1:15-cv-3702 (N.D. III.); undated; pp. 1-4.
Olsen, Eddie; Automatic Shuffler 'ready' for Atlantic City experiment; Blackjack Confidential; Jul./Aug. 1989; pp. 6-7.
Gros, Roger; New Card Management System to Be Tested At Bally's Park Place; Casino Journal; Apr. 1989; 5 pages.
Gola, Steve; Deposition; *Shuffle Tech International* v. *Scientific Games Corp., et al*. 1:15-cv-3702 (N.D. III.); Oct. 13, 2016; pp. 1, 9-21, 30-69, 150-167, 186-188, 228-231, 290-315, 411; Henderson Legal Services, Inc.; Washington, DC.
*Shuffle Tech International LLC et al*. vs. *Scientific Games Corporation et al*., Order Denying Motion for Summary Judgement: Memorandum Opinion and Order, in the U.S. District Court, for the Northern District of Illinois Eastern Division, No. 15 C 3702, Sep. 1, 2017, 35 pages.

* cited by examiner

Fig. 5A
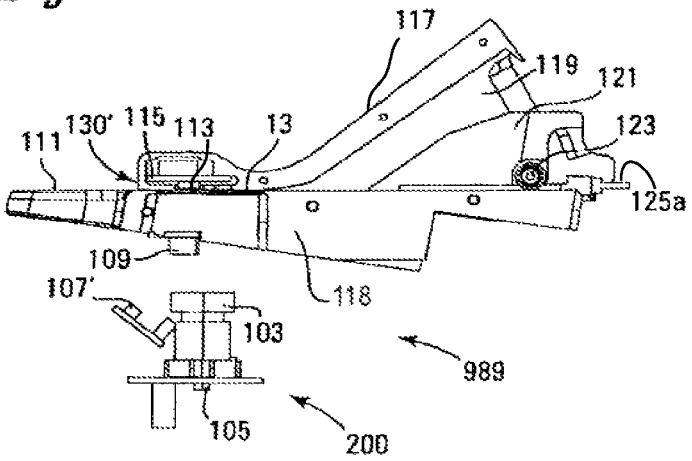
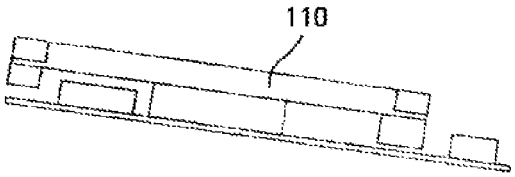
Fig. 5B

CARD HANDLING DEVICES AND SYSTEMS

CROSS-REFERENCE TO RELATED APPLICATIONS

This application is a continuation of U.S. patent application Ser. No. 14/090,730, filed Nov. 26, 2013, now U.S. Pat. No. 9,126,103, issued Sep. 8, 2015, which is a continuation of U.S. patent application Ser. No. 13/204,988, filed Aug. 8, 2011, now U.S. Pat. No. 8,590,896, issued Nov. 26, 2013, which is a continuation-in-part of U.S. application Ser. No. 12/321,318, filed Jan. 16, 2009, now U.S. Pat. No. 8,511,684, issued Aug. 20, 2013, which is a continuation-in-part of U.S. application Ser. No. 12/291,909, filed Nov. 14, 2008, now U.S. Pat. No. 8,490,973, issued Jul. 23, 2013, which is a continuation-in-part of U.S. application Ser. No. 12/287,979, filed Oct. 14, 2008, now abandoned.

TECHNICAL FIELD

The present technology relates to the field of playing card-handling devices such as shufflers (both batch and continuous), delivery shoes, card discard trays and the like. These card-handling devices may have card reading or imaging capability and may be in communication links with other intelligent components in a casino environment.

BACKGROUND

In the gaming industry, especially in casino table gaming, there has been a significant move toward more automation. Playing cards are read, wagers are electronically read, player identifications are read, and the totality of the information is communicated to one or more processors, servers or computers to store and/or analyze the information for gaming and record keeping functions.

As with many technological improvements, there are often sacrifices by workers, often in the sense that functionally improved environments may not be as ergonomically satisfactory as more traditional modes of operation. The environment of playing card delivery and removal is one particular area of dissatisfaction amongst dealers in the casino table card game environment.

Originally, dealers would take one or more decks of playing cards, shuffle them manually, and deliver cards out of their hands. Dealers were able to move, bend, twist, shift forward and backwards, lift their arms and had a great degree of freedom of movement. Even though the work was repetitive, this freedom of movement relieved some of the physical stress that can build up when working long hours in a single position, with repetitive movements. Even with the initial advent of delivery shoes in the 1950s, the dealers were still able to move while they were manually shuffling cards. The delivery shoes were small and light and moved easily over the gaming surface.

With the successful penetration of the casino market with automatic shufflers, primarily by Bally Gaming, Inc., the dealers are no longer required to perform repetitive shuffling tasks, but they have less freedom of movement during work. The shuffler is typically mounted in a fixed position on a table, positioned so that the structure does not interfere with play and in a position that is intended to be comfortable for a dealer of average size. The dealer inserts cards in a single stationary location, the playing cards are shuffled, the dealer removes the playing cards from a stationary card delivery tray or chute, and the dealer deals out the cards to each player position, himself and or a community position.

Shufflers, in particular, can vary significantly in height, width, depth and function on a table. Different functions include batch shufflers (which randomize a complete set of cards, which are then removed from the shuffler as a group, or in multiple subgroups) and continuous shufflers (a number of cards always remain in a shuffler, smaller subsets are removed periodically, and spent cards are reintroduced into the shuffler and randomized into the number of cards that remain in the shuffler). Some shufflers are mounted flush with a gaming table surface, while others are fixed to a platform adjacent the table or mounted with brackets to a side of the table adjacent the dealer's position. Yet others sit on the table surface. Each of these positions requires the dealer to make repetitive moves to a single stationary position where the shuffler remains stationary. As dealers are of different heights, arm-lengths and flexibility, there is no perfect single position at which a playing card system, such as a shuffler, may be fixed.

As mentioned above, some shufflers such as the ONE2SIX® shuffler, as described in U.S. Pat. No. 6,659,460 rest on the gaming table surface. Although the ONE2SIX® shuffler is capable of being repositioned on the table surface, its elevation with respect to the gaming surface is high as compared to more low profile shufflers.

Examples of continuous and batch shufflers that are known in the art and may be used in the practice of the present invention include, by way of non-limiting examples, those shown in U.S. Pat. Nos. 7,384,044; 7,322,576; 7,261,294; 7,255,344; 7,234,698; 7,137,627; 7,059,602; 7,036,818; 6,905,121; 6,886,829; 6,719,288; 6,651,981; 6,588,751; 6,588,750; 6,568,678; 6,254,096; 6,149,154 and the like. Each of these patents is incorporated herein by reference, in their entirety. Some of these shuffling devices also have built-in card-reading capability.

Similarly, any delivery shoe or discard rack may be used on a gaming table, such as those disclosed, by way of non-limiting examples, in U.S. Pat. Nos. 7,407,438; 7,374,170; 7,278,923; 7,264,241; 7,213,812; 7,114,718; 6,637,622; 6,402,142; 6,299,536; 6,039,650; 5,722,893; and the like, each of which is incorporated herein by reference.

BRIEF SUMMARY

Playing card delivery devices such as card shufflers, card shoes and discard racks comprise a housing and a support base. The support base is supported by a gaming table surface.

The housing includes an area that stores multiple playing cards, and an opening in the housing through which playing cards may be removed.

A structure extends below the support base, positionable in an aperture in a gaming table. The support base is movable on the gaming table surface. Movement is limited by an area defined by the size and shape of the aperture in the table.

The present invention may be characterized as a playing card delivery system. The system includes a gaming table having a top play surface with an aperture extending therethrough. A playing card delivery device with a playing card delivery shoe is elevated with respect to an elevation of a playing card reader located in the playing card delivery device. The playing card reader is insertable in the aperture. The device is mounted so that the playing card reader is located below the game table top play surface and the playing card delivery shoe is located above the top play surface.

The present invention is a modular card-handling device. The device includes a base, a shoe that is fixedly mounted to the base, and a card-holding device comprising a card infeed area and a card output area. The shoe has a quick-release locking mechanism that connects the shoe to the card output area of the card-handling device.

The present invention may also be characterized as a card-handling system having an area for holding cards, a card input area and a card output area. The card output area is configured for manual removal of one card at a time. The card output area has an opening for removal of cards that is offset from a center of the card output area.

BRIEF DESCRIPTION OF THE DRAWINGS

FIGS. 5*a* and 5*b* are detailed side cut away views of the card-reading shoe's sensors, camera system, and processing components with support structures removed.

DETAILED DESCRIPTION

Figure 1:
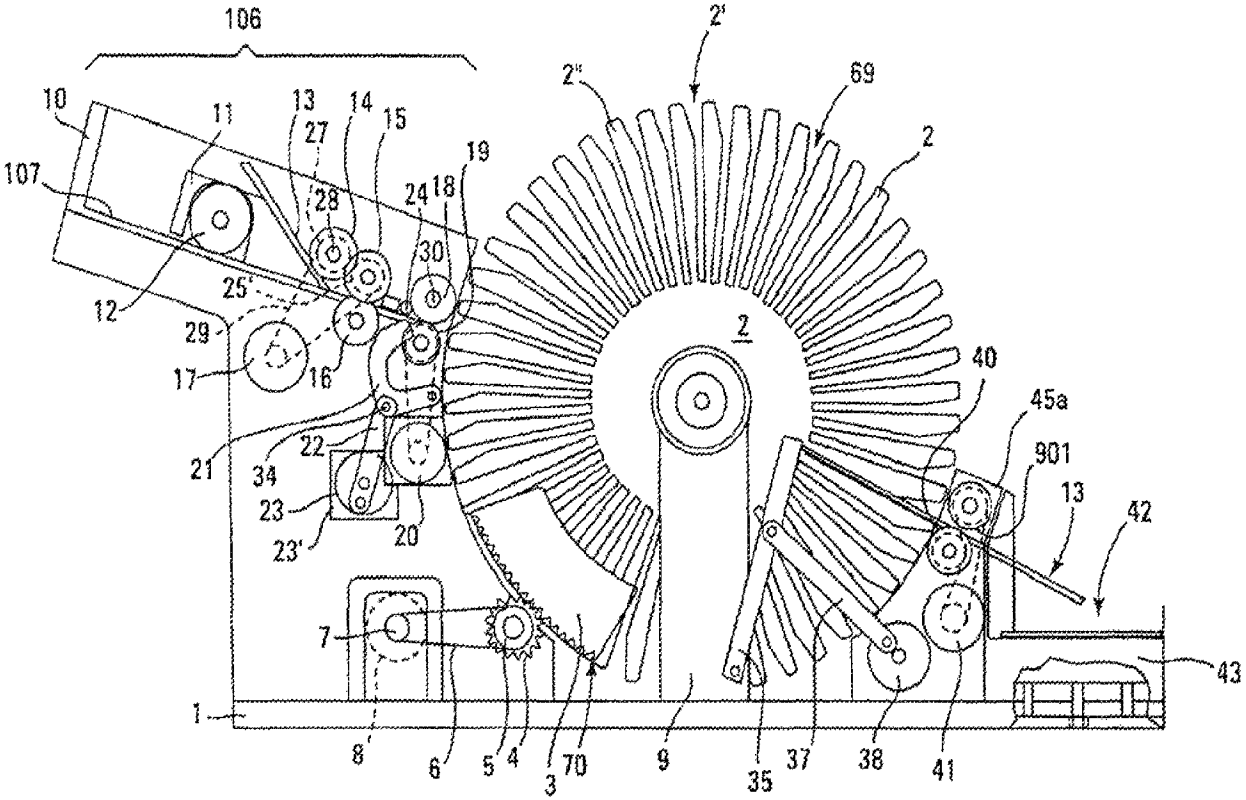
FIG. 1 is a side elevational view of a playing card shuffler (with cover removed) with a removable delivery end that is one example of a playing card-handling device of the present invention.

Playing card-handling devices, such as shufflers, dealing shoes, discard racks and verification systems are movably mounted to a gaming table to allow for functional and ergonomic adjustment of the card-handling device. Structures of the present invention provide card-reading capability without increasing the height of the device on the table. The playing card-handling device is attached to the gaming table in a manner that allows the dealer to rotate, swivel or move the device linearly in a defined area on the table. A relatively flat base beneath the playing card-handling device remains relatively parallel to the flat surface of a gaming table and rests on the gaming table surface as the card-handling device is repositioned. The device is able to slide and pivot in directions parallel to the surface of the gaming table. At the same time, range of movement is restricted to fix the device with a predetermined surface area of the gaming table. Major movement no greater than 30 cm, for example, is restricted in any single direction along the surface of the gaming table.

Near one end of the device is the area of the device that is attached to or positioned to extend through an aperture in the table. The area of attachment is preferably a front end of the device from which playing cards may be removed as individual cards, subsets of cards (e.g., hands of cards during a round of play of a game), and complete sets of cards (e.g., a deck of cards or multiple decks of cards, or all playing cards remaining after exhaustion of a predefined amount of play of the game).

For purposes of this disclosure the term "attachment" means connected with physical means or the movement restricted by a combination of the weight of the device and the size of the aperture from which a portion of the device extends therethrough. In the second instance, the weight of the device prevents detachment of the device from the table.

If the card-handling device is a discard rack, the pivot point is located near the area that receives spent cards. If the device is a shoe, the point of attachment is preferably the card delivery end of the shoe. It is preferable that the point of attachment be proximate the card-imaging system when an imaging system is part of a modular addition to an existing structure. This arrangement minimizes the height of the card-handling device.

At least rotation of the device within a defined area of the gaming table (i.e., an aperture) is required, and some X-Y components of movement parallel with the plane of the surface of the gaming table is optionally allowed. The rotation of the device within a defined area preferably maintains the base of the device relatively parallel to the plane of the surface of the gaming table, but some rotation or elevation of the rear of the device off of the surface of the gaming table may also be allowed or not. The rotation capability does not have to be 360 degrees, but may be limited as designed to less than 360 degrees, including 180, 145, 120, 100, 90 or 45 degrees. A rotation of at least 10 degrees up to those limits is desired. In one form of the invention, the card-handling device is a shuffler and the shuffler is positionable on a base that is supported by the gaming table surface.

The precise mechanism for attachment of the device may be varied, as the design requires, as long as the swiveling function is present. It is preferred that the card-handling system of the present invention includes a camera reading system built into the device. In one example, the card-reading system is positioned at least in part below the gaming table surface, especially at a position below an area of the device over which playing cards are moved and especially removed from the device (such as the front delivery tray or shoe in the device). Non-limiting examples of mechanisms that may be used for attachment of the card-handling device (with or without a separate base) to the gaming table include a male fixture (spindle, rod, bolt, post, pin or the like, and one or multiple posts may be used) on the device and a female receptor (hole, threaded hole, opening, or the like) on the gaming table surface. The male and female elements may be reversed with respect to the device and the table. Snap attachments (receptors and inserts), clips and inserts, slide engaging elements, opposed plates with locking elements, recesses and plates, and other known locking or locking and release systems may be alternatively used.

The attachment may or may not be the component that itself enables rotation (e.g., a post in a hole receptor), and is preferably a fixture carried on the table (in whole or in part) or carried on the card-handling device such as a shuffler (in whole or in part). Among the preferred constructions is the use of a platform or base set slightly above, flush with or slightly recessed into the surface of the gaming table or a platform attached to the gaming table or a platform adjacent to the gaming table. By having a separate platform or panel, initial installation, replacement, repair and upgrading of the attachment system may be easily effected. The panel may be built into the table and carry one half of the attachment subcomponent or the device itself may carry the platform or panel with it so that the panel on the device can be attached to receptors on the table. The panels, whether built into the table or the device, may have male or female subcomponents built therein. If both the device component and the table component have female receptors, a separate male-male connector may be used.

In one preferred form of the invention, the mode of attachment is a substantially circular support plate that lies over an aperture of a smaller diameter. A portion of the device, preferably the card-imaging system is mounted to the support plate. The device is movable within the aperture. Preferably, the diameter of the aperture is much larger than a diameter of an outer circumference of the card-imaging system protective cover, allowing for a range of movement within the aperture.

The system, devices and components of the present technology may be generally described as follows. A playing card-handling device that can be associated with a casino table has a housing with a support base. There is an area within the housing that can store multiple playing cards, such as sets of cards, a single deck of playing cards or multiple decks of playing cards. There is an opening in the housing through which playing cards may be removed. The base of the playing card delivery device has a connector attached to the base. The device is movable within the connector. The support base moves within a single plane, while the support base is supported by a gaming table or platform placed adjacent to or is attached to a gaming table. The preferred embodiment is to have the playing card delivery device movably mounted (pivotally and/or for linear movement) to a gaming table, but a platform may be attached to an edge of the gaming table, or a platform moved to a position adjacent the gaming table, with the playing card delivery device instead supported by the platform.

The support base is preferably in contact with a top surface on the gaming table, the single plane comprising the top surface of the gaming table. In one embodiment, the connector may be a panel that is attached to the gaming table and rotates in a plane parallel to the surface of the gaming table. In another alternative, the panel is attached to the gaming table and is seated at a level above, flush with or below the top surface of the gaming table. In other embodiments, the panel is attached to the card-handling device. The device is preferably a playing card shuffler and alternatively is a delivery shoe, a discard rack or a deck verification device. Both batch shufflers and continuous shufflers may be used. The shuffler preferably has a playing card reader that sends signals indicative of at least rank (and also suit and other special markings) of a playing card, the reader located below the support base to minimize a height of the device above the surface of the gaming table. The placement of the playing card reader below the surface of the gaming table and provision of the rotating and linear movement functions reduces the overall height of the shuffler above the gaming table surface and improves ergonomics by both the reduced height and the movable positioning capability. The playing card reader preferably is fixed at an angle between about 70 and 89 degrees or between about 70 and 85 degrees with respect to the plane of the gaming table top surface. This provides a wider angle of vision when reading the playing cards and improves reading accuracy. The playing card reader moves with the shuffler as the shuffler moves about the top surface of the gaming table.

The present invention may be characterized as a playing card delivery system. The system includes a gaming table having a top play surface with an aperture extending therethrough. The system also includes a playing card delivery device having a playing card delivery shoe elevated with respect to a playing card reader located in the playing card delivery device. The playing card reader is insertable into the aperture of the gaming table. The playing card delivery device is mounted so that the playing card reader is located below the game table top play surface and the playing card delivery shoe is located above the top play surface.

One example of a playing card delivery device, contemplated by the present invention, includes a playing card shuffler with the playing card reader built into a front, playing card delivery end. The playing card delivery device is movable about the front end of the device while the playing card reader remains below the top play surface.

In another example of the invention, the playing card delivery device comprises a playing card delivery shoe, with the playing card reader built into a front delivery end of the shoe. The shoe is movable about the front end of the device while the playing card reader remains below the top play surface.

In one preferred form of the invention, a swivel plate is attached to a front end of the card delivery device, and the swivel plate rotates in a plane parallel to the top play surface. When the card delivery device is a shoe, the playing card reader and the playing card shoe are fixedly attached such that the combined device defines a removable module.

Regardless of the type of playing card-handling device, according to the invention, the movement of the playing card delivery device on a gaming table is limited by the geometry of the gaming table aperture and the geometry of a structure housing the playing card reader. Preferably, the playing card delivery device is movable in a plane parallel to the gaming surface and in at least one of the following directions: rotational, arc-shaped, straight line and an irregular path.

The present invention may also be defined as a modular card-handling device. The device in its broadest sense includes a base, a shoe that is fixedly mounted to the base and a card-holding device. The card-holding device includes a card infeed area and a card output area. According to the invention, the shoe has a quick-release locking mechanism that connects the shoe to the card output area of the card-handling device.

In one example of the invention, the card-handling device has a card-imaging system. The card-handling device may also include a card-shuffling mechanism or removable cartridge. The card-imaging system may be affixed to the card output area of the card-holding device, wherein the card output area is removable from the card-shuffling mechanism. In one example of the invention, a processor board is mounted in the base. The processor communicates with the card-imaging system. In an example of the invention, the card output area is fixedly mounted to the base.

According to the invention, a card-handling system is provided, comprising an area for holding cards to be used in a card game, a card input area, a card output area, the card output area capable of providing one card at a time for manual delivery to a card game, wherein the card output area has an opening for removal of cards that is offset from a center of the card output area. In an example of the invention, the card-handling system further comprises a card-imaging system, wherein the card output area has an upper plate, wherein the upper plate is larger on a first side than on a second side, wherein the card-imaging system is positioned beneath the larger side. A light source may be located beneath the larger side. The card-handling system may be a shoe, a shuffler or a discard rack.

A review of the figures will further enhance an appreciation of the scope of the present technology. FIG. 1 shows a left-side perspective view of a non-limiting example of one embodiment of a modular shuffler design that can be used in association with the technology described herein. This shuffler is described in detail in U.S. Pat. No. 6,659,460 (the disclosure incorporated by reference above). This patent is owned by a subsidiary of Bally Gaming, Inc. of Las Vegas, Nev. This shuffler is shown with a removable hand-forming front end 43, but the shuffling mechanism may be used in connection with the technology of the present invention.

A shuffling storage means 2' or carousel is situated on a console formed of two legs 9, which is arranged on a base plate 1. Shuffling means is accomplished by a rotatably held drum or carousel 2. The drum 2 is connected via spacers (not shown) with two disks 3. The flanges 2" of the drum 2 are provided with multiple compartment-like slots 69 which are provided for receiving playing cards 13. Preferably, each compartment is capable of holding one or more cards.

The disks 3 are each provided with a circular toothing 70. The shuffling storage means 2' can be driven via a pinion 4 and a toothed pulley 5, which is rigidly connected with the same, with pinion 4 and toothed pulley 5 both being jointly held rotatably in place by bars or side supports (not shown), and a toothed belt 6 via a second toothed pulley 7 and a motor 8, as shown in phantom. The motor 8 is driven via a random-check generator and optionally moves the shuffling storage means 2' in mutually opposite directions, so that an oscillating movement of the shuffling storage means 2' can occur.

A storage container 10 (card input area) for the played cards 13 is provided, which is part of an input apparatus assembly 106. The input apparatus assembly 106 comprises a wedge 11 that rolls by way of a support roller 12, which is arranged rotatably in the same on an inclined floor 107 of the storage container 10 against two elastic rollers 14. The two rollers 14 are held rotatably on a common shaft 28 in the side walls (not shown) of the storage container 10 and can be driven jointly with the rollers 15 via belt 29 (optionally a toothed belt not shown), as well as a pulley 27 via a motor 17. Two rollers 16 touch the two rollers 15 at a circumference, so that they are co-rotated by surface friction.

Two bridges each form with the floor 107 of the storage container 10 a gap-like draw-in zone 25', which is substantially the thickness of one playing card 13 to guarantee that only one card at a time is conveyed to the shuffling storage means 2'. A sensor 24 is provided as a preferably optical sensor for recognizing the respectively moved playing card 13. Every playing card 13, which is moved from the storage container 10 to the shuffling storage means 2', must therefore at first pass the gap-like draw-in zone 25' one after the other and then the sensor 24, with the sensor 24 being covered or triggered at first by the playing card 13 entering a sensor zone and being uncovered again after the passage of the playing card 13. An electronic control, preferably a microprocessor, which is provided downstream of the sensor 24, therefore registers the change from covered to uncovered as the playing card 13 passes, as long as the electronic control does not recognize a jam in the card path.

The electronic control adds the playing cards 13 inserted one by one into the randomly selected individual compartments 69 of the shuffling storage means 2' to an electronic register and subtracts the playing cards 13 taken from individual compartments 69 according to their number from the electronic register with the goal of keeping a continual inventory of the playing cards 13 situated in the card-handling device. In one example of the invention, a random group of playing cards 13 is formed in each compartment 69.

A jam in the card path is recognized when the rollers 14, 15 or 19 are blocked and thus the motors 17 and 20 show an increased power consumption. Alternatively, a jam can be recognized when the playing card 13 covers the sensor 24 for a longer period than corresponds to the conveying speed of rollers 14 and 15 (and opposing roller 16) with respect to the conveyance of a playing card 13 or when the sensor 24 remains uncovered for a longer period although the electronic control triggers the drive of the rollers 14 and 15 and the playing cards 13 are located in the storage container 10, which fact can also be verified through a sensor (not shown) in floor 107.

The roller pair 19 and the pair of rollers 18, which touches the other pair on the circumference and which are each situated on a shaft 30, can be driven in the same manner by motor 20 as described above.

The two levers 21 are used for fully pushing the respectively moved playing card 13 into a compartment 69 of the shuffling storage means 2' and can be driven in an oscillating fashion via a rod 22, which is swivelably connected with one of the levers 21 by a shaft 34, through an eccentric disk 23 seated on the motor 23'.

The output of the playing cards 13 from the compartments 69 to a modular, hand-forming card storage means 42, occurs by means of two swiveling arms 35, which are swivelably held in the two legs 9 and are oscillatingly drivable via lever 37 and via an eccentric disk 38 seated on a motor (e.g., a card unloader). The two swiveling arms 35 each carry at their upper end an inwardly projecting rail (not shown), which grasps the playing cards 13 situated in a compartment 69 and conveys them to a nip line of two clamping rollers 40. The clamping rollers 40 are held in plate bars and are simultaneously drivable by a motor 41.

The clamping rollers (or nip rollers) 40 convey the respectively moved group of playing cards 13 to the card storage means 42, as shown in FIG. 1, for the shuffled cards for the purpose of a stack-wise removal of the group of playing cards 13, or to an alternate modular card storage means, described below (not shown) for a removal of shuffled playing cards 13 one at a time.

When playing cards 13 are removed from the compartments 69 of the shuffling storage means 2', this occurs via the withdrawing apparatus 35, 37, 38, as described above. In the present embodiment, a compartment 69 can only be emptied completely. Since the electronic control system is informed at all times about the number of playing cards 13 per compartment (=card value) it is thus easy to determine how many cards are taken from the shuffling storage means 2' and placed into a modular card output end.

A sensor detects actuation of the withdrawing apparatus 35, 37 that eject all cards from a compartment 69 as a group so that they are further carried by rollers 40 (in housing 45*a*) through nip 901 between rollers 40*a*, 40*b*, and ejected into a delivery shoe as described below. Motor 41 drives nip rollers 40.

The sum total of the playing cards 13 situated in the shuffling storage means 2' is thus obtained in a simple manner by the addition of the playing cards 13 inserted in the shuffling storage means 2' and the subtraction of the playing cards 13 removed therefrom.

It is understood that the method can also be applied to a card shuffler which allows the removal of individual playing cards 13 from the shuffling storage means 2', i.e., an entire compartment 69 is therefore not completely emptied. In this case it is not necessary that the electronic control system stores the number of playing cards 13 per compartment 69, because after the removal of the individual playing cards 13 from the shuffling storage means 2' the same can be moved past a sensor again. As a result, the electronic control system is informed at all times about the playing cards 13 individually supplied to and removed from the shuffling storage means 2', as a result of which the sum total of the playing cards 13 situated in the shuffling storage means 2' is always known. This shuffler with the tray module 43 removed is one preferred card-shuffling component of the present invention. These and other features of this non-limiting example of a shuffler may be found in U.S. Pat. No. 6,889,979, which is incorporated by reference herein in its entirety.

Figure 2:
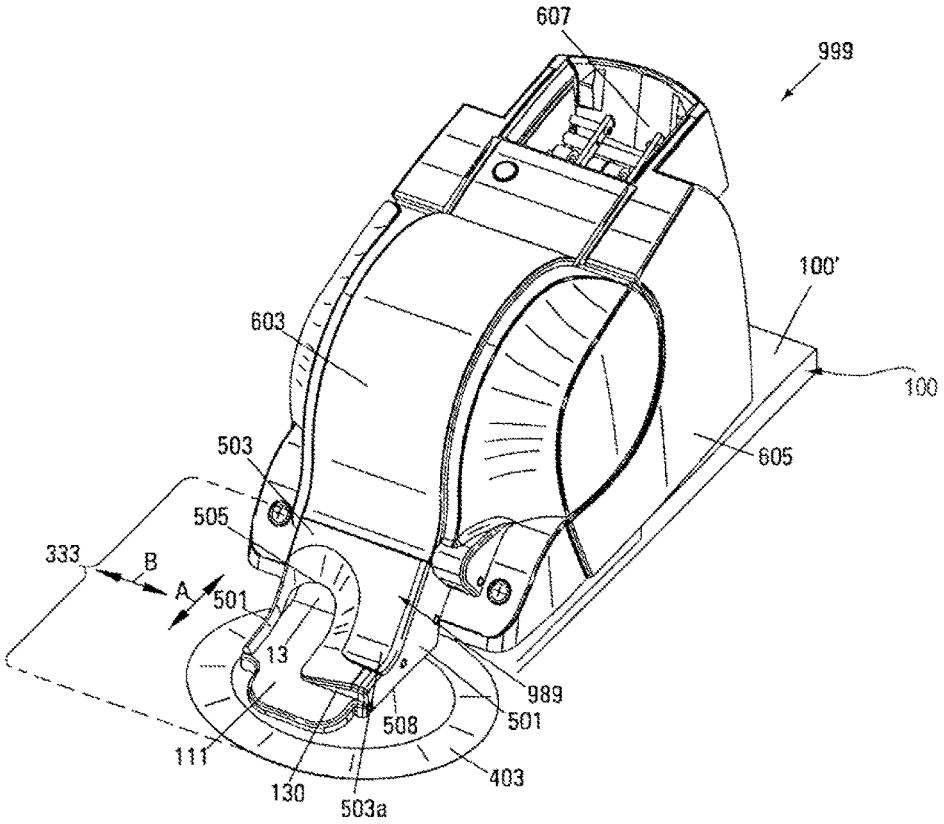
FIG. 2 is a perspective view of an exemplary playing card-shuffling device fixed to a movable base.

FIG. 2 is a perspective view of a card delivery device of the present invention. The device includes a shuffler 999 that is positioned on a base 100. The base 100 includes a substantially flat portion 100' that is positioned beneath the shuffler 999, a substantially flat, circular swivel plate 403 and a delivery shoe assembly 989, both affixed to the flat portion 100'. A playing card insertion area 607 is shown on the shuffler 999. A housing encloses the mechanism shown in FIG. 1 for shuffling playing cards. Section 333 defines a playing card delivery zone comprising a delivery shoe assembly 989. The delivery shoe assembly 989 in this embodiment is affixed to the flat portion 100' but is removably attached to the shuffler 999, as is described in more detail below. In other embodiments, the delivery shoe assembly 989 is removably attached to the flat portion 100'. In yet other embodiments, the delivery shoe assembly 989 is removably attached to the shuffler 999, and the swivel plate 403 is attached to the delivery shoe assembly 989, and there is no separate base. Delivery shoe assembly 989 has a front cover plate 503 with a beveled finger insertion slot 505 that exposes a playing card 13 for withdrawal. Additional portion 503*a* and side wall 501 are additional portions of the front cover plate 503. A flat draw plate 111 provides a surface across which playing card 13 is drawn and read by a playing card-imaging system 200 (shown in FIG. 3) located under the flat draw plate 111. Extension plate 130 stabilizes the playing cards 13 as they are individually withdrawn. The swivel plate 403 in one embodiment is securely fastened to a base 508 of the delivery shoe assembly 989 by an attachment system. As pressure is applied by a dealer against the left side 605 (or the right side 605 shown in FIG. 9) of the shuffler 999, the shuffler 999 pivots by forcing the swivel plate or cover plate 403 to rotate with respect to its connection point to the table about axis 901' (shown in FIG. 3). The entire plate 403 may also have more limited motion forward and backwards, for example, in directions A and B with respect to the plate 403 by slides, glides pins in elongated holes and the like (not shown). When plate 403 is a swivel plate, it actually moves with the rotation of the card delivery device. In other embodiments, plate 403 is a cover plate, that is fixed on the table, does not rotate, and the connector between the card delivery device and the cover plate 403 allows relative rotation of the card delivery device. In one embodiment, the swivel plate 403 is fixed with respect to the shuffler 999 and pivots and otherwise moves in the plane of the gaming surface, but is not mechanically attached to the table.

In alternative embodiments (not shown) the card-handling device is a shoe and the shuffler 999 is replaced with a card-holding cartridge that feeds cards into the delivery shoe assembly 989. Suitable cartridges are fully disclosed in U.S. application Ser. No. 12/228,713, filed Aug. 15, 2008, titled Intelligent Automatic Shoe and Cartridge, and assigned to Bally Gaming, Inc. The content of this application is incorporated by reference in its entirety.

Figure 3:
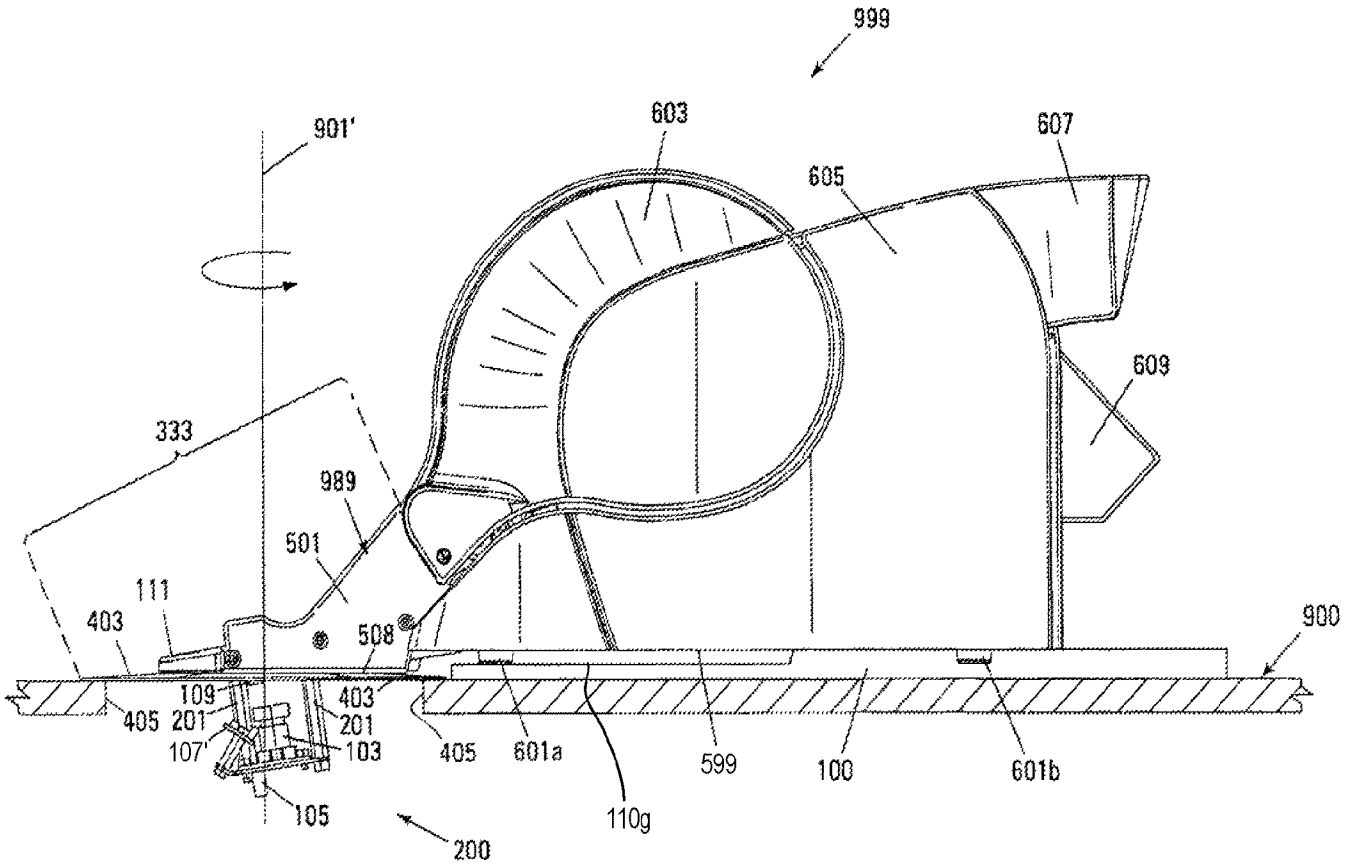
FIG. 3 is a left-side elevational view of a playing card shuffler mounted on a movable base that is supported by a gaming table surface.
Figure 12:
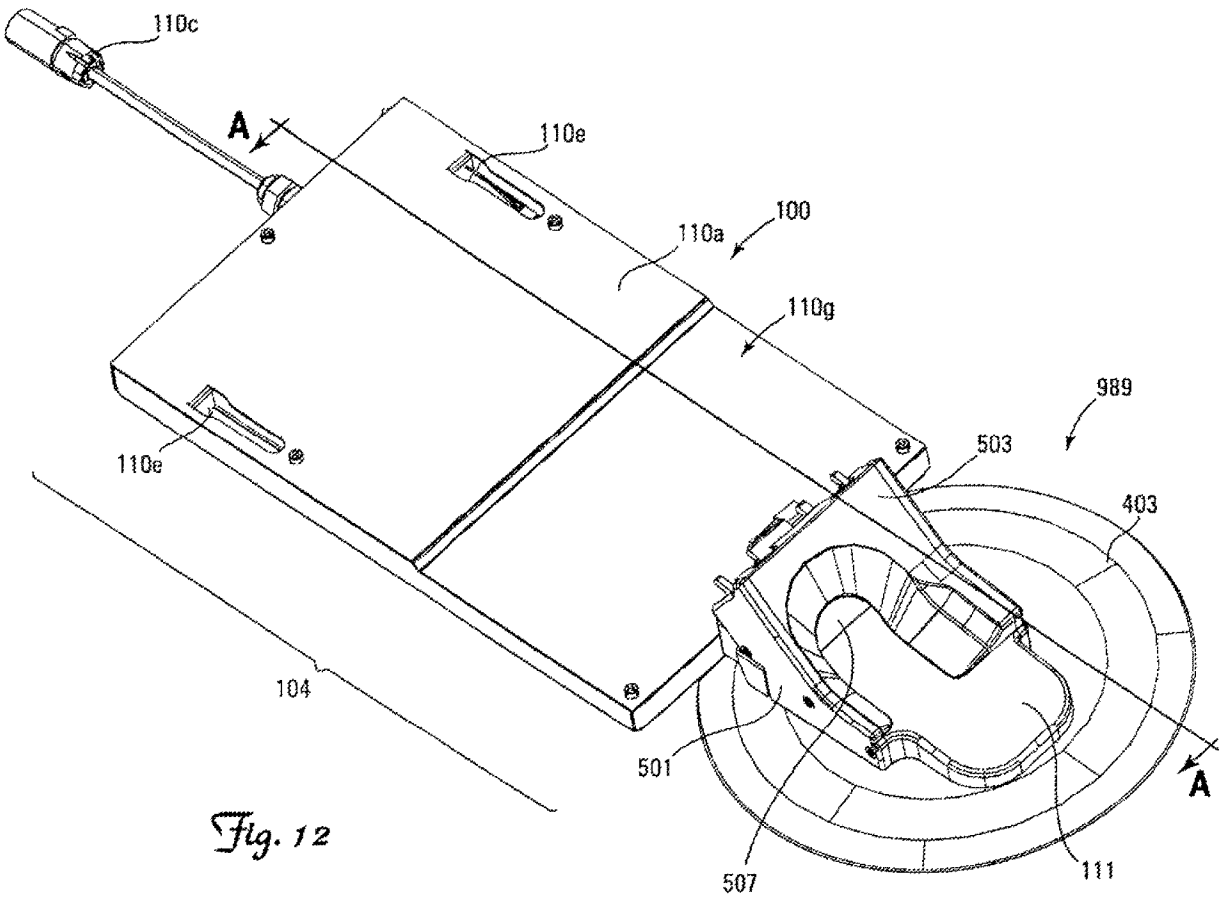
FIG. 12 is a top perspective view of the card-reading shoe assembly attached to a base.

FIG. 3 is a left-side elevational view of a playing card shuffler 999 (including base 100) with a playing card-imaging system 200 (for suit and/or rank) mounted below the shuffler 999. Two support posts 601*a*, 601*b* are shown supporting the shuffler 999. A pair of support posts 601*a* foremost the delivery shoe assembly 989 rests on a second upper surface 110*g* and a second pair of support posts 601*b* sits within apertures 110*e* in base 100 (FIG. 12). At the playing card insertion area 607, a display panel 609 is provided to display card information, game status information and/or shuffler state information. The imaging system 200 is located beneath a lower surface 599 of the shuffler 999.

The base 508 of the delivery shoe assembly 989 is mounted to the swivel plate 403 and the swivel plate 403 rests on the gaming table surface 900 in a rotatable manner by sliding a housing 210 (FIG. 17) containing the imaging system 200 into a table aperture 405 that extends through a gaming table surface 900. The swivel plate 403 is shown resting on the gaming table surface 900. The flat draw plate 111 extends from the front cover plate 503 by which playing cards 13 pass as they are withdrawn.

The imaging system 200 preferably includes a camera (such as a CMOS camera) 103 is used as the playing card reader and is supported within angled frame support 201. The focal plane of camera 103 is aimed through image window 311 (FIG. 6) which exposes at least part of the face of playing cards 13 as they are manually slid across the flat draw plate 111. Adjustable elements (not shown) are used to adjust the angle of the camera 103. As the shuffler 999 pivots and or otherwise moves horizontally, the entire imaging system 200 and the entire structure beneath the game table surface 900 also moves. In one example of the invention, the movement of the device relative to the table is limited to pivotal movement about axis 901'. In other embodiments, the device is movable freely within an area defined by the size and shape of the table aperture 405 in the table and the X-Y dimensions of the imaging system 200 protective housing 210 (see FIGS. 14 and 17).

Figure 4:
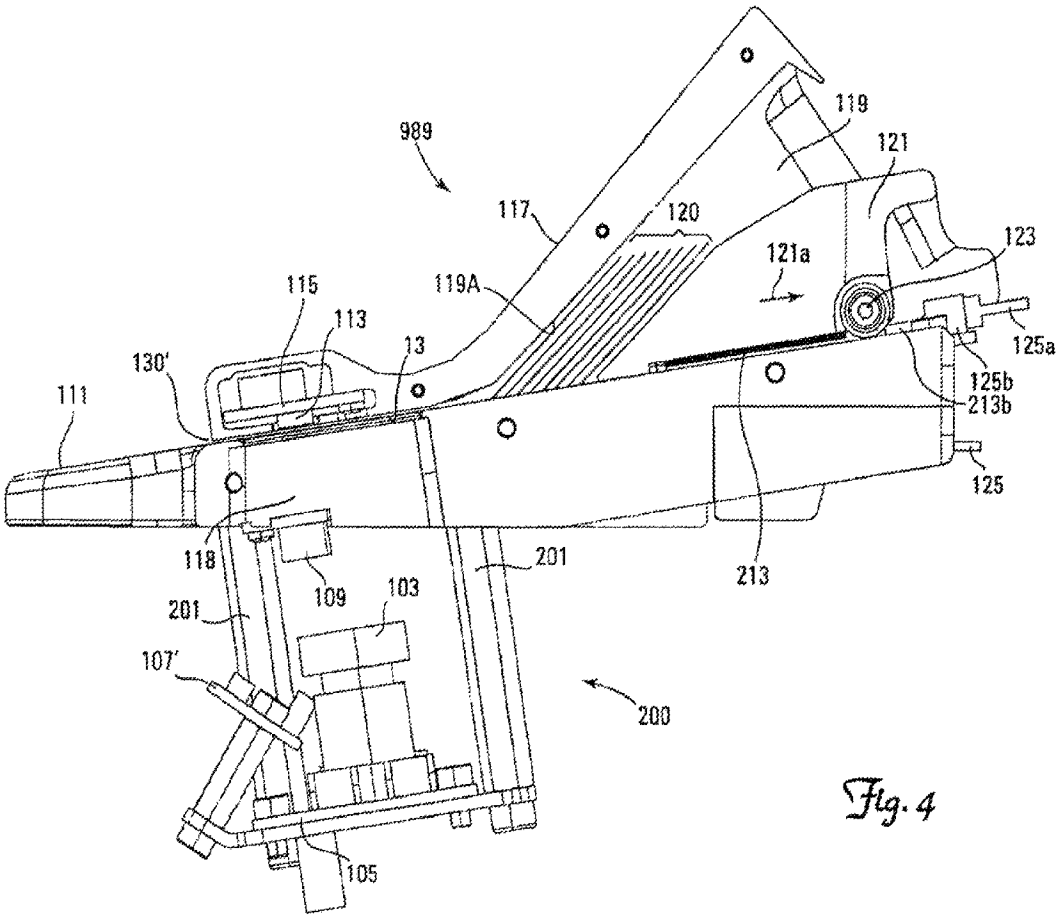
FIG. 4 shows an expanded partial cutaway left-side elevational view of a playing card delivery shoe and playing card reader assembly that may be pivotally mounted on a game table.

FIG. 4 shows a partial expanded left-side elevational view of a card delivery shoe assembly 989 and associated card-imaging system 200 that is removable with respect to the shuffler 999 but is fixed to the base 100. A sliding block or card wedge 121 is shown with a roller 123. The incline may be varied in design so as to vary the pressure placed on cards by the sliding block or card wedge 121. This sliding block or card wedge 121 presses against the stack of playing cards 120 so that an individual playing card 13 can be manually drawn out over the flat draw plate 111 past a front face 117 of the delivery shoe assembly 989. Like reference numbers in FIGS. 3 and 4 refer to like elements. A spring 213 may be attached to the base of the sliding block or card wedge 121 to assist in controlling forward and return movement. The spring 213 is elevated above the surface on which the sliding block or card wedge 121 glides.

Front sloped face 119A contacts a leading face of the stack of cards 120 as the cards are pressed forward. A cable/wire connection 125 for transmitting data/signals from the delivery shoe assembly 989 is shown at the rear of the delivery shoe assembly 989. A back direction barrier or stop 213*b* is provided to impede the roller 123 from being too easily removed from the delivery shoe assembly 989. An exit slot or card gap 130' is shown just in front of the flat draw plate 111, which allows only one playing card 13 at a time to be pulled through the card gap 130'.

As a card-receiving area 119 is emptied by the dealer relative to a minimum card capacity of, for example, seven to nine cards, depending on the thickness of a single card, the sliding block or card wedge 121 is in a "fill" position, a wedge magnet(s) 125*a* contacts a magnet sensor board 125*b*. The magnet sensor board 125*b* senses the number of cards in the shoe. When the shoe is empty, the shuffler's processor receives the signal generated by the magnet sensor board 125*b* and subsequently begins dispensing more cards into the card-receiving area 119. This operation relates to a mechanized delivery shoe, in which playing cards are automatically delivered into the delivery end of the delivery shoe. As the playing cards 13 are dispensed from the shuffler 999 (FIG. 3) component into the card-receiving area 119 of the modular delivery shoe assembly 989, the sliding block or card wedge 121 is pushed back toward the shuffler 999 in direction 121*a*. Once the card-receiving area 119 is completely filled to capacity, the sliding block or card wedge 121 is in a "home" position. At this point, the magnet sensor board 125*b* is in signal transmission, and the shuffler processor instructs the shuffler 999 to stop dispensing cards into the shoe card-receiving area 119. As cards are removed from the dispensing end of the delivery shoe assembly 989 in FIG. 4, and put into play, the sliding block or card wedge 121 begins to slide toward the dispensing end of the delivery shoe assembly 989 and the magnet sensor board 125*b* goes out of contact with magnets 125*a*.

FIG. 5A is an expanded view of the card delivery shoe assembly's 989 card-imaging system 200, and processing components 110, as shown in FIG. 5B, with support structures removed. A card gap or exit slot 130' is provided between the front face 117 of the delivery shoe assembly 989 and the card-dispensing platform or flat draw plate 111, wherein the card gap 130' is large enough to receive only one card at a time as it exits the card-receiving area 119. A camera trigger sensor emitter 113 is positioned in the upper housing of the shoe and above the card gap 130'. A camera trigger sensor receiver 109 is positioned on the bottom of the shoe's lower housing 118 and parallel to an image window 311 (see FIG. 6), wherein the image window 311 is, for example, a glass plate positioned and securely fixed in an aperture 312 created in the shoe ground plate 305 (see FIG. 6).

The card-imaging system 200 is positioned below the camera trigger sensor receiver 109 and parallel to the lower surface of the image window 311 (see FIG. 6). The card-imaging system 200 preferably includes at least one two-dimensional CMOS camera 103, an image processing module 105, and an LED light board 107' (FIG. 5A). In a preferred embodiment, the card delivery shoe assembly 989 has a shoe main circuit board 110, as shown in FIG. 5B, with an independent processor. Once a card image is captured and processed by the shoe's imaging system 200, the card information is sent to the shoe main circuit board 110 of the card delivery shoe assembly 989, and it is the shoe main circuit board 110 that is linked to an external network game computer and/or a processor (not shown). Preferably, there is no communication between the shoe main circuit board 110 and the shuffler main circuit board (not shown). In other embodiments, the shoe main circuit board 110 communicates with the shuffler processor (not shown).

The camera trigger sensor emitter 113 preferably emits a constant signal to the camera trigger sensor receiver 109, wherein both sensors are communicating when in an idle state. The camera trigger sensor emitter 113 is provided with a trigger sensor emitter cover plate 115, wherein the trigger sensor emitter cover plate 115 blocks ambient light sources and/or photon noise that can interfere with image acquisition. In a preferred embodiment the imaging system 200 is offset from a centerline of the delivery shoe assembly 989. As shown in FIG. 2, the imaging system 200 (see FIGS. 3, 4, and 5A) lies below an additional portion 503*a* of front cover plate 503. This additional portion blocks the camera light source from the view of the user, and additionally blocks ambient light that could interfere with imaging. By offsetting the imaging system 200, a larger sized focal area and a larger cover is obtained, improving the performance of the imaging system 200 over known systems that position the finger insertion slot 505 centrally on the front cover plate 503.

Figure 6:
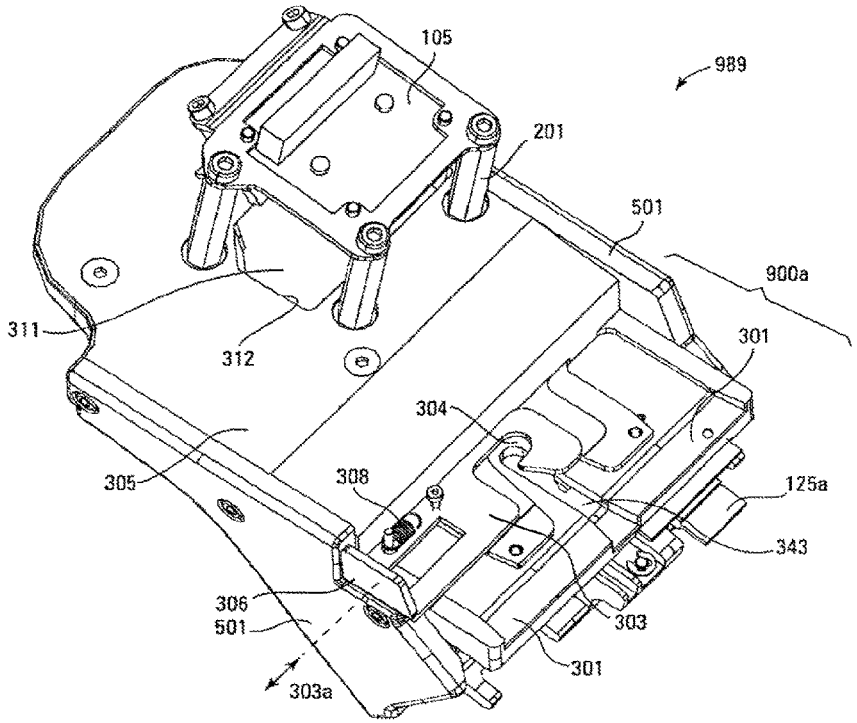
FIG. 6 is a perspective view of a lower surface of the removable card shoe assembly (with mounting base removed).

The LED light board 107' provides a constant available green LED light source that is angled at the image window 311 (see FIG. 6). As a playing card 13 (see FIG. 5A) exits the card-receiving area 119 and enters the imaging area, the camera trigger sensor emitter 113 light source is blocked by the presence of the playing card 13. In addition, the trigger sensor emitter cover plate 115 ensures the imaging system 200 has a black background necessary for acquiring an accurate card scan. At this point, the camera trigger sensor emitter 113 is no longer providing a signal to the sensor receiver 109, wherein the presence of the playing card 13 is blocking signal transmission. The lack of a sensor emitter signal activates/notifies the camera trigger sensor receiver 109 that a card is present, wherein the sensor receiver 109 sends a signal to the CMOS camera 103. The CMOS camera 103 immediately responds and images the card symbols, wherein the card is positioned face down above the image window with rank and/or suit visible. The lighting board 107' facilitates the image acquisition by providing the CMOS camera 103 with a constant green LED light source that shines through the image window 311 illuminating the symbols/indicia on the playing card 13.

FIG. 6 shows a perspective view of a lower surface of the modular card delivery shoe assembly 989 with its shuffler attachment assembly 900*a* visible at one end of the shoe ground plate 305. In FIG. 6, the lower shoe housing 409', as shown in FIG. 7, has been removed to display the components of the shuffler attachment assembly 900*a* as shown in FIG. 6.

Figure 9:
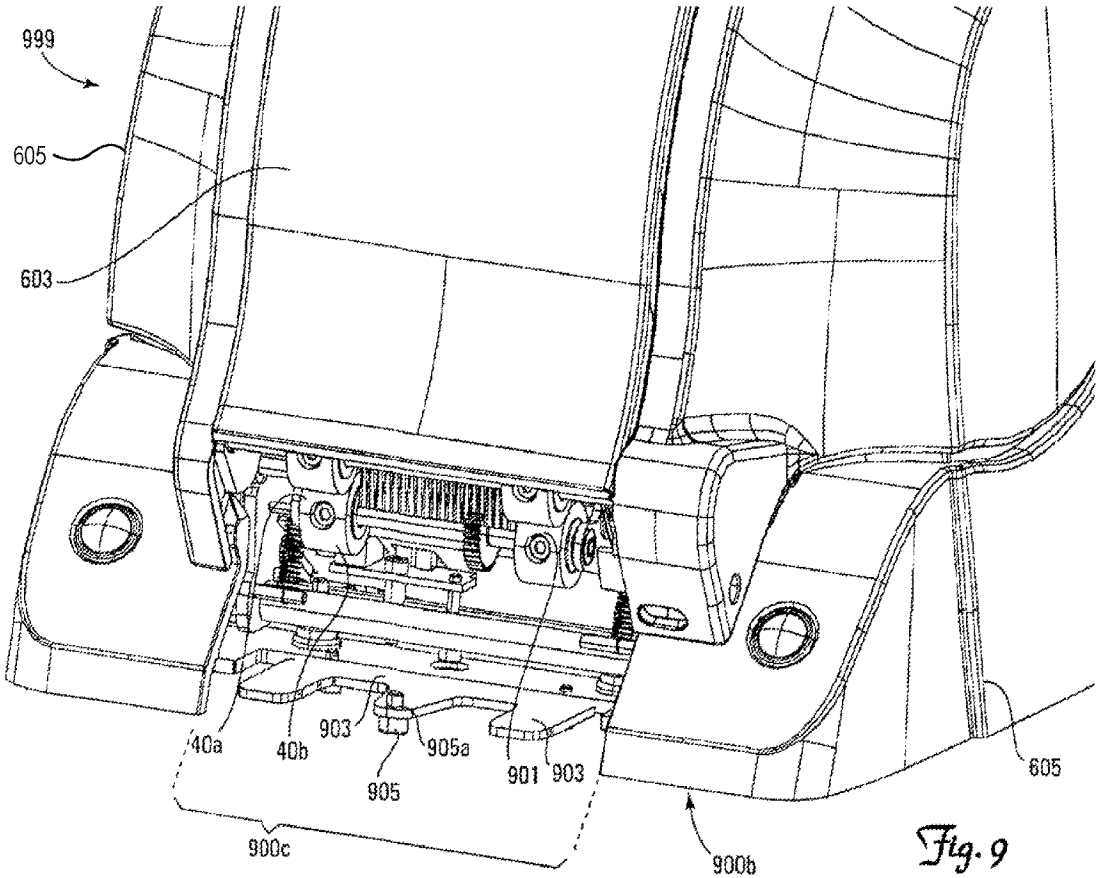
FIG. 9 is a perspective view of the card-dispensing end of the shuffler with the card shoe assembly and base removed.

The shoe ground plate 305 forms a lower portion of the delivery shoe assembly 989, relative to a card-dispensing end 900*c* of a shuffler 999 (FIG. 9) and includes a ground plate structure 301. The ground plate structure 301 is designed to fit flush against the upper surface of the shuffler's shoe attachment plate 903, as shown in FIG. 9. A locking pin aperture 343 (see FIG. 6) is cut into the ground plate structure 301. A shuffler locking pin 905 (see FIG. 9) fits into the locking pin aperture 343. A locking slider 303 has a slot-shaped aperture 304 that engages the shuffler locking pin 905. The locking slider 303 moves in the direction of arrow 303*a* and a tongue 306 is recessed within the side wall 501 when the locking slider 303 is in the locked position. A spring 308 biases the locking slider 303 in the locked position. The locking slider 303 allows for quick release and attachment of the delivery shoe assembly 989 to the shuffler 999 (FIG. 9). Advantageously, no tools are needed to exchange the delivery shoe assembly 989 with a replacement shoe (not shown) in the event of a card-imaging system 200 malfunction, or when it is desired to replace the shoe/card-imaging assembly with another type of front end, such as tray module 43 shown in FIG. 1.

Figure 7:
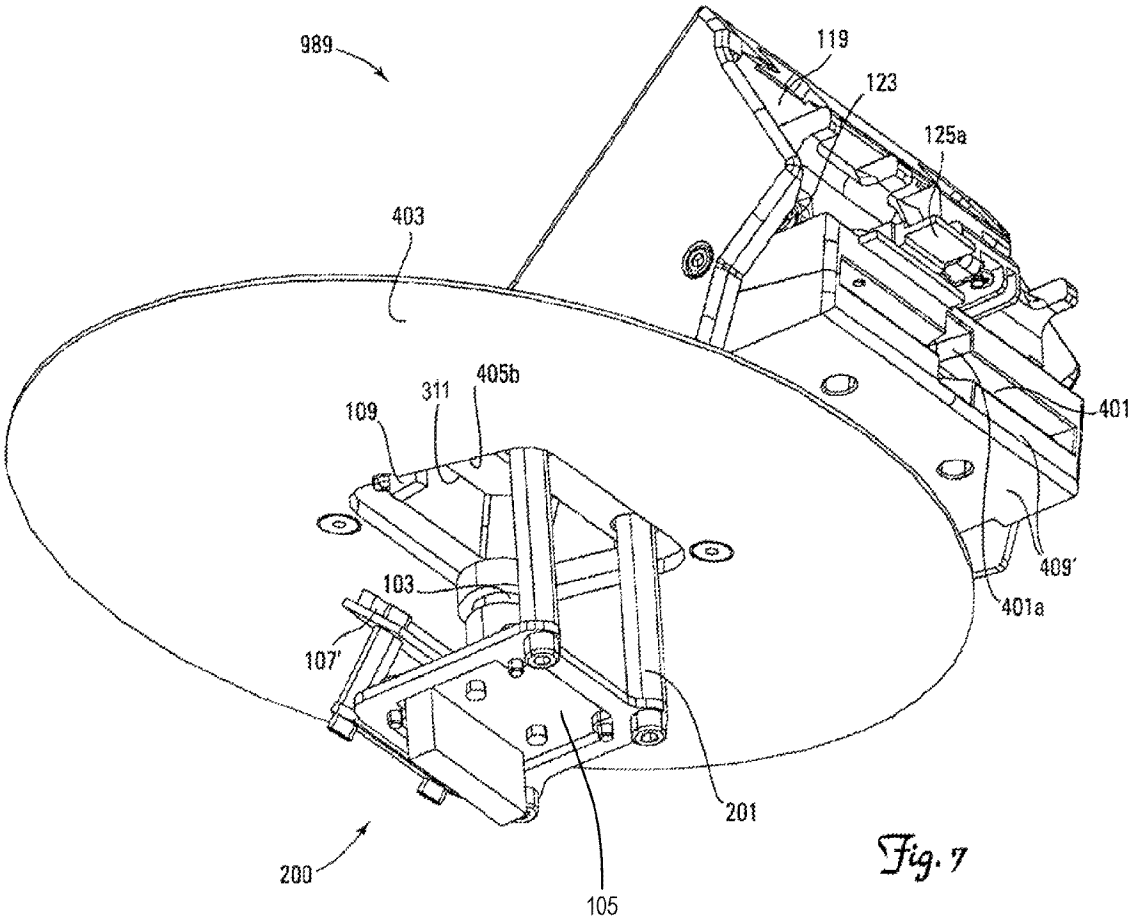
FIG. 7 is a perspective view of the lower surface of the card shoe assembly with mounting base removed.

FIG. 7 is a perspective view of the delivery shoe assembly 989 with swivel mounting plate 403 attached. The view represents a lower side of the delivery shoe assembly 989. In this figure, a shoe housing 409' is installed over the locking components 303, 304, 343 and an aperture 401 is provided with a locking pin-receiving area 401*a*. The shoe cover plate or swivel plate 403 has a plate aperture 405*b* with dimensions equal to and/or slightly greater than the dimensions of the playing card-imaging system 200 support structure. Preferably, the imaging system 200 is inserted through the cover plate aperture 405*b*, wherein the cover plate or swivel plate 403 rests on the table surface. In other embodiments, the swivel plate 403 is rotationally mounted on a lower base plate (not shown).

Figure 8:
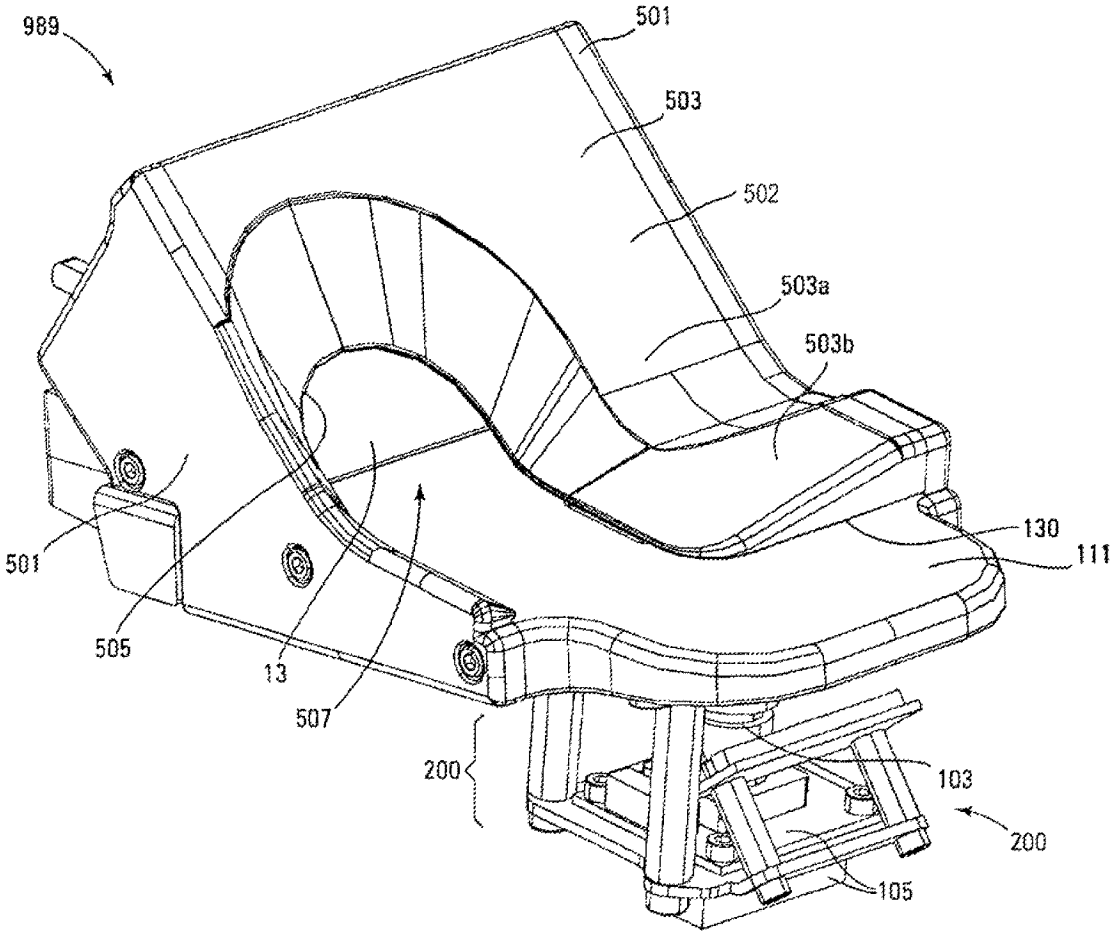
FIG. 8 is a top perspective view of the card shoe assembly with protective housing.

FIG. 8 illustrates the relative positioning of the card-imaging system 200 relative to the front cover plate 503 of the card shoe 502. The front cover plate 503 has an additional descending portion 503*a*. Beneath the additional portion 503*a* is housed the camera trigger sensor emitter 113 and the sensor plate 115 (FIG. 5A). The flat draw plate 111 is located beneath the additional portion 503*a* and surrounds the image window 311 (FIG. 6). The camera trigger sensor receiver 109 (FIG. 5A) is positioned on the lower surface of the flat draw plate 111 (FIG. 8) and below the image window 311, as viewed in FIG. 7. As depicted in FIG. 8, the front cover plate 503 includes a first larger side bordering the finger insertion opening or slot 505 on a first side and a second smaller side bordering the finger insertion opening or slot 505 on a second side, where the first larger side completely overlies the camera 103 of the card-imaging system 200.

The image window 311 according to a preferred form of the invention is offset from a centerline of the shoe. It is advantageous to offset the opening of image window 311 because more space is then provided for the imaging system 200. Since the light source for the imaging system 200 is preferably constant, it is an advantage to provide a larger area 503*b* covering the imaging system 200 so that the light is not seen by a user, and so that ambient light does not interfere with imaging. Otherwise, when a card is not present, the light source would be apparent to a user.

Figure 14:
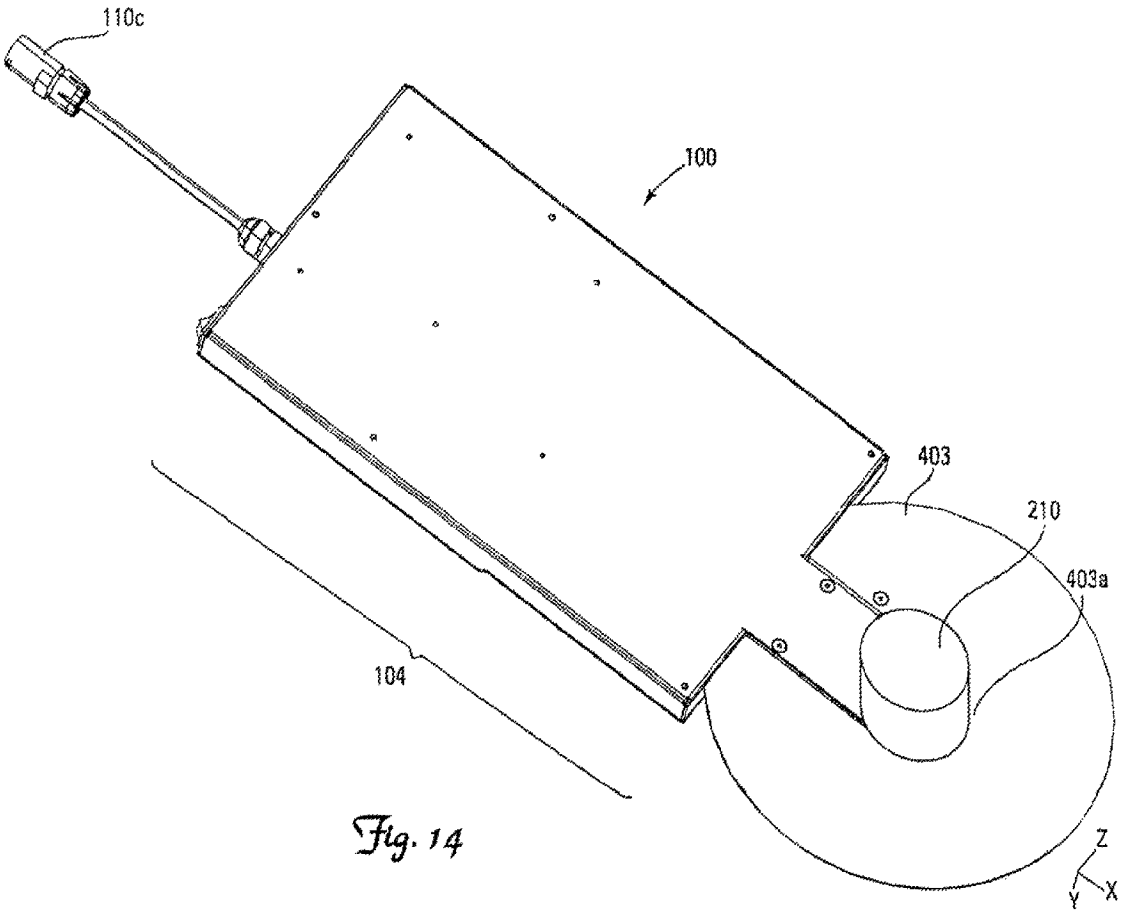
FIG. 14 is a bottom perspective view of the card-reading shoe assembly and base illustrating one example of the exterior imaging system housing.

FIG. 14 provides a bottom view of the card-reading shoe system, wherein the main circuit board base 100 has a second upper surface 110*g* that is substantially flat and an exemplary cylindrical external housing 210 of the imaging system 200 are clearly displayed. The swivel plate 403 also has a substantially flat lower surface 403*a*. Referring back to FIG. 8, the card path starts at area 507. A dealer manually applies finger pressure to the playing card 13 at the beveled finger insertion slot 505. As the dealer moves the card outward and over the top surface of the flat draw plate 111, the card passes under the additional portion 503*a* and over the image window 311 (FIG. 7) wherein the camera trigger sensor receiver 109 (FIG. 5A) is activated and the card-imaging system 200 (FIG. 8) captures an image of the playing card 13 as it is removed from the flat draw plate 111 and put into play. The shutter speed of the camera is fast enough that variations in the rate at which cards are removed does not impact image capture and/or capture image quality. Additionally, angling of the camera toward the focal point through the image window 311 increases the field of vision of the camera and enables greater accuracy in the reading of information from the faces of the cards.

FIG. 9 shows a card-dispensing end 900*c* of the shuffler 999 with the detachable delivery shoe 989/base 100 detached. The shuffler 999 has an upper surface with left and right sides 605 and a top cover 603. At the lower end of the top cover 603, the nip rollers 40*a* and 40*b*, are exposed. A card nip line 901 is shown between the nip rollers 40*a* and 40*b*, wherein the card nip line 901 allows only a formed group of one or more randomized cards to exit the shuffler 999. Although a preferred shuffler 999 has compartments configured to form groups of cards, the shuffler 999 is programmable to insert only one card into a compartment so that only one card is dispensed. The delivery shoe assembly 989 is fixedly mounted to base 100 (see FIG. 12). The shoe attachment assembly 900*b* includes a shoe attachment plate 903 with a shuffler locking pin 905 secured into an aperture 905*a* located on the shoe attachment plate 903.

Figure 10:
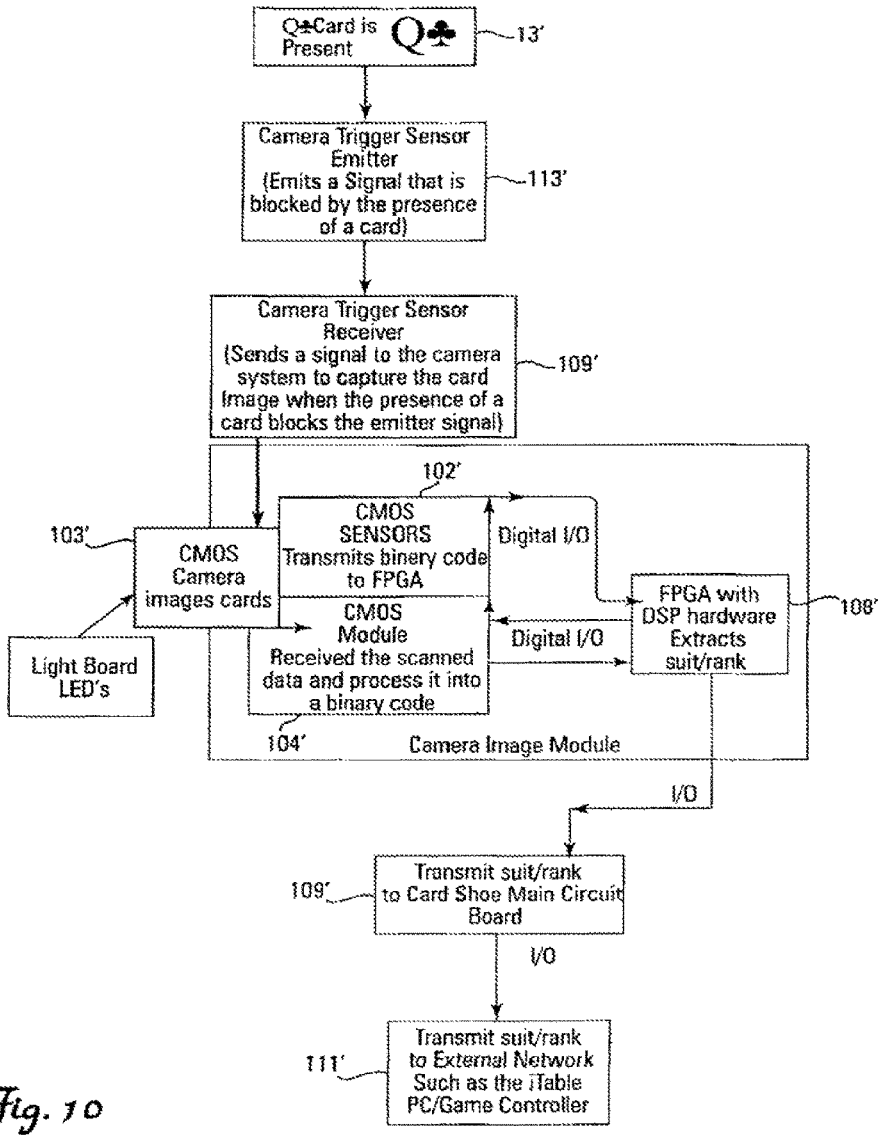
FIG. 10 is a schematic diagram of the functions of a card-reading module.

A schematic flow diagram of the camera imaging system process and associated data transfer is provided in FIG. 10. The process includes a step 13' of positioning a card in the imaging area. A camera trigger sensor senses (step 113') the presence of the card. When the card is present, this signal is blocked. A camera sensor receiver senses the blocked state (step 109'), triggering the operation of the imaging system. According to the process, a CMOS camera images the card (step 103'). The CMOS module processes the captured data and converts the data to binary code. This binary code is transmitted (step 102') to an FPGA with DSP hardware to extract card rank, suit or rank and suit (step 108').

Once the scanned image is acquired (step 103') by the CMOS camera, as shown in FIG. 10, the CMOS (complementary-metal oxide semiconductor) module reduces the black and white card data to a series of gray scale values (step 104'), wherein the gray scale values are then assigned a binary code. This binary code is transmitted (step 108') to at least one FPGA/DSP (Field Programmable Gate Arrays/Digital Signal Processors) hardware component, wherein the FPGA/DSP hardware component has associated memory with stored binary codes relative to each of at least one card rank and a suit. The FPGA/DSP hardware correlates the new binary code with stored binary codes and determines the rank and suit of the card. Once the rank and suit determination has been completed by the FPGA/DSP hardware component(s), it is the FPGA/DSP that transmits (step 109') the rank and suit information to the shoe main circuit board 110. The card information is then transmitted (step 111') to an external computer or onto an external network. Preferably, the shoe main circuit board 110 (see FIGS. 5B and 13) is linked to an operatively associated PC and/or external network, via I/O port 110*c*, such as, but not limited to, a table PC/game controller with programmed game rules relative to the game in play, wherein the PC/game controller determines a game outcome based upon the card data transmitted from the shoe main circuit board 110.

FIG. 12 shows the base 100. The assembly includes a first upper surface 110*a* that defines an upper main circuit board housing, and a second upper surface 110*g*. Apertures 110*e* accept the rear opposing support posts 601*b* of the shuffler 999 (FIG. 3). The front support posts 601*a* of the shuffler 999 rest on the second upper surface 110*g* when the shuffler 999 is mounted to the base 100. The delivery shoe assembly 989 also defines a portion of the plate assembly (see FIG. 14). In a preferred form of the invention, delivery shoe assembly 989 is fixedly attached to a rectangular portion 104 by means of screws, bolts or other known fasteners. In another embodiment, the shoe assembly (not shown) is removably attached to the rectangular portion 104 of the base 100 by means of a quick connect/disconnect fastener.

Figure 13:
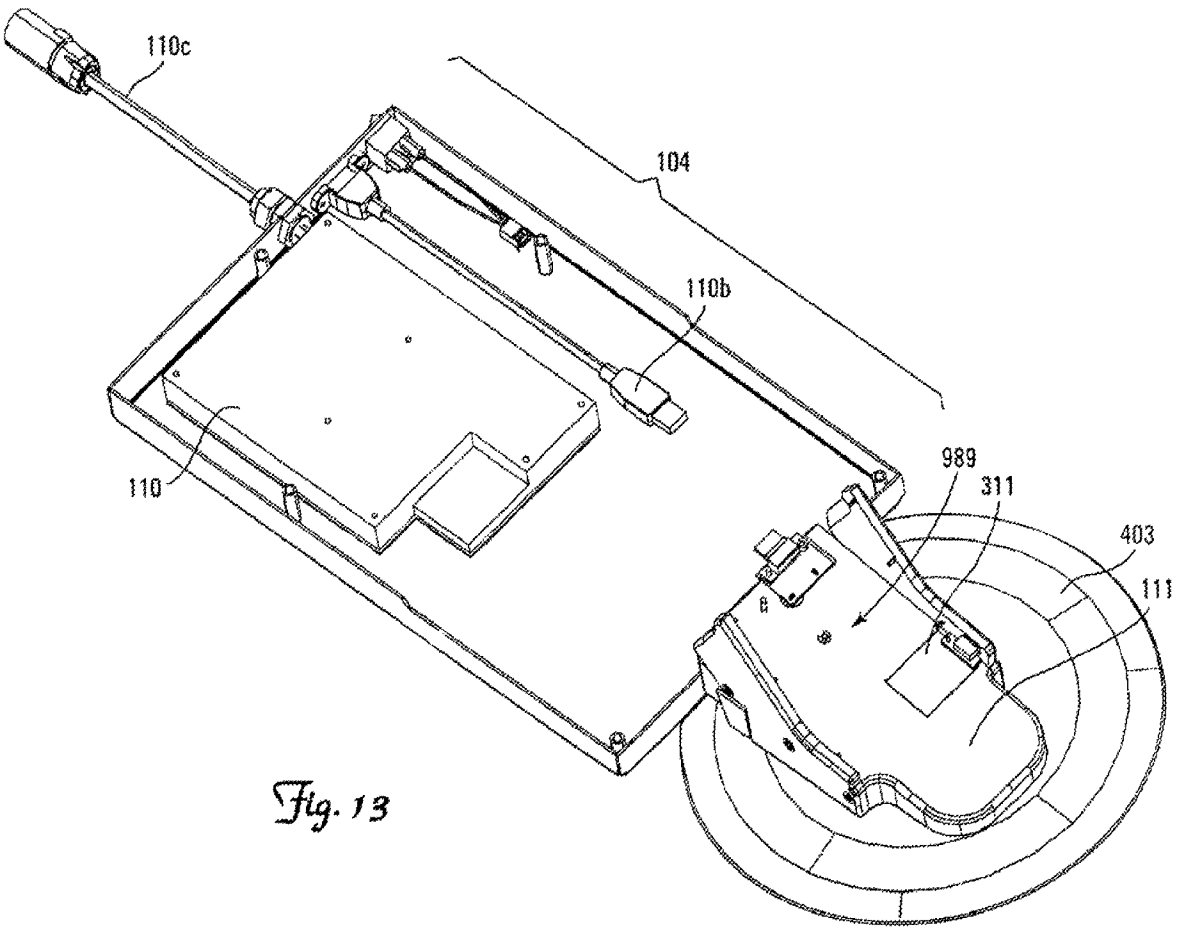
FIG. 13 is a top perspective view of the card-reading shoe assembly and base supporting the shoe main circuit board with upper protective housing structure removed.

FIG. 14 shows this same base 100 from below. The assembly includes the mounted swivel plate 403, wherein the swivel plate 403 is fixedly attached to the rectangular portion 104 via screws. FIG. 13 shows the same structure from above with the main circuit board housing removed, revealing shoe main circuit board 110 and I/O ports 110*b* and 110*c*. An I/O port 110*c* allows the shuffler 999 (see FIG. 3) to communicate with an external computer and/or network. Internal I/O port 110*b* in one embodiment is a USB port. The USB port may be used to connect the shoe processor with a removable display/user interface.

Figure 15:
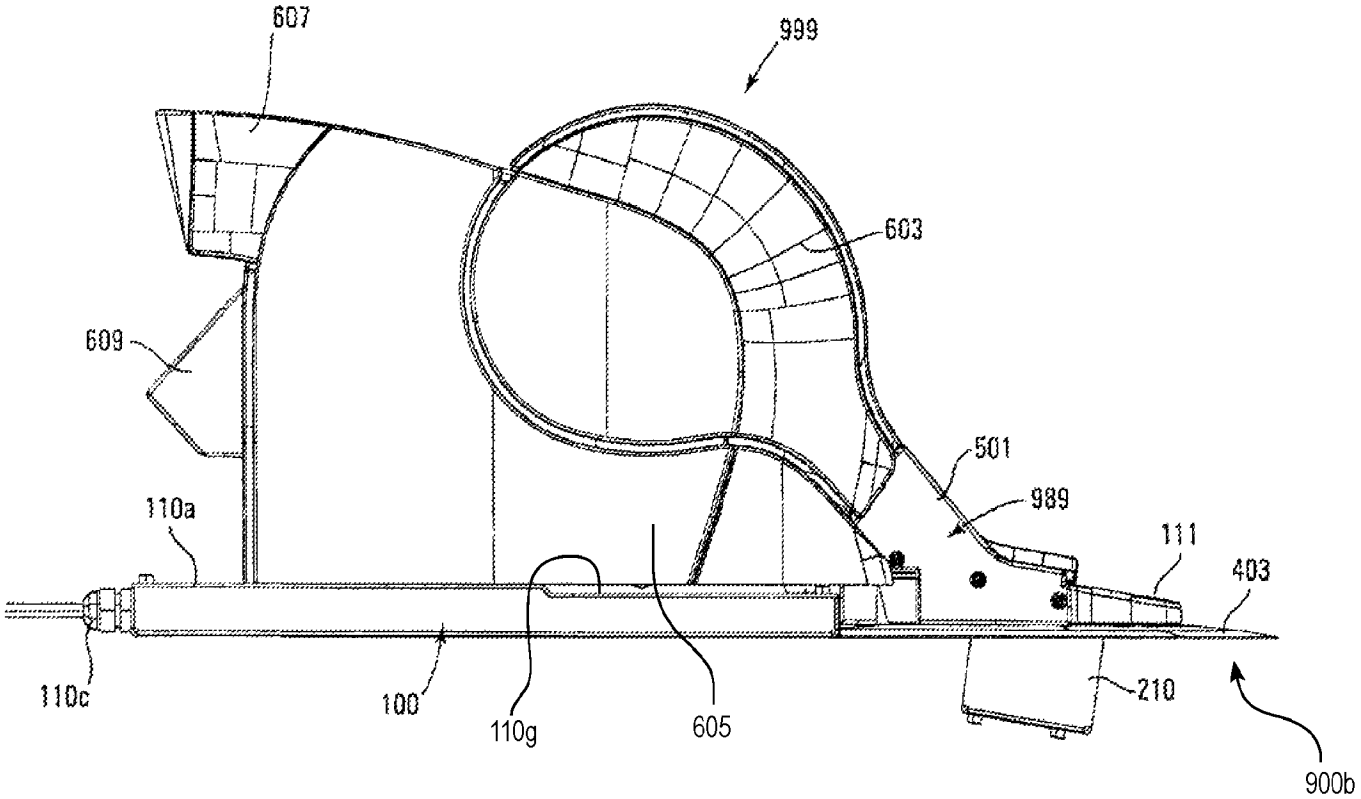
FIG. 15 is a side elevational view of an exemplary shuffler/shoe system mounted to a base with affixed exterior housings.

This interface/display can be used to train the card-reading system to recognize different cards. For example, a library of card data, one data set corresponding to each brand of cards may be input into the shoe main circuit board 110 so that the card-imaging system is capable of accurately reading each brand of card in the library. In alternative embodiments, I/O port 110*b* allows the shoe main circuit board 110 to communicate with the shuffler processor (not shown). After the library of card values is input, the input/display device may be disconnected from I/O port 110*b*. The main circuit board housing is replaced (FIG. 12) and the shuffler 999 may then be mounted on the base 100, as shown in FIG. 15.

The card delivery shoe assembly 989 is removably attached to the dispensing end of the shuffler 999 (FIGS. 9 and 15) by lining up the shoe locking pin aperture 343 (FIG. 6) with the shuffler locking pin 905 (FIG. 9) and manually sliding the shoe toward the shuffler 999. Once the shuffler locking pin 905 is pushed along the entire length of the shoe locking pin aperture 343, the shuffler locking pin 905 travels into the shoe locking slider 303 (FIG. 6). The shoe locking slider 303 secures the shoe to the shuffler locking pin 905 with the shoe ground plate structure 301 (FIG. 6) resting level on the upper surface of the shuffler's shoe attachment plate 903 (FIG. 9).

Figure 17:
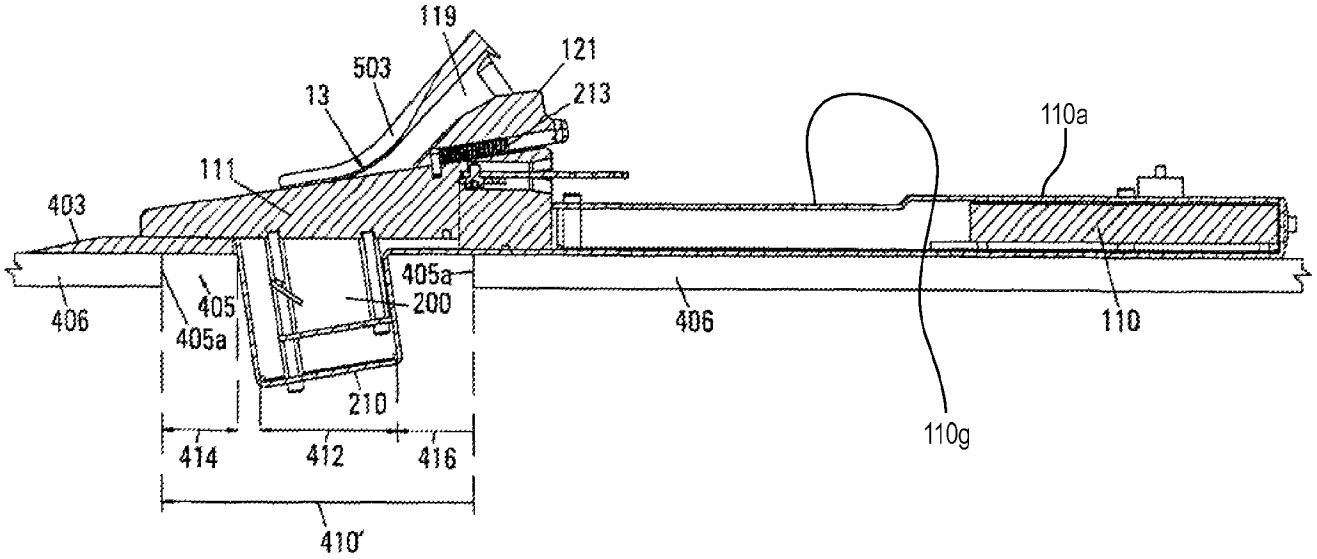
FIG. 17 is a cross-sectional view of the base/shoe assembly shown in FIG. 12, taken along line A-A.

A cross-sectional view of the structure shown in FIG. 12 taken along lines A-A is shown in FIG. 17. The imaging system 200 in one embodiment is protected by an external housing 210. The external housing 210 is preferably cylindrical and completely encloses the imaging system 200 to prevent damage and tampering.

The inner edges 405*a* of table top 406 and table aperture 405 are shown. This table aperture 405 in one embodiment is circular and of a diameter 410' that is much larger than a diameter 412 of external housing 210. The entire structure is capable of movement relative to this table aperture 405. The shuffler 999 (FIG. 15) is capable of rotational motion, linear motion arcuate motion and combinations thereof. As shown in FIG. 17, the shuffler 999 (FIG. 15) can be moved a distance 414 or a distance 416 within the boundaries of table aperture 405. The base plate 403 is of a size and shape such that the table aperture 405 is completely covered and out of the view of the players, regardless of the position of the shuffler relative to the table. In a preferred embodiment, the base plate 403 is circular or oblong in shape.

Shufflers of the present invention advantageously maintain a low profile and at the same time are adjustable on the table top to suit the size, and preferences of the dealer.

Figure 18:
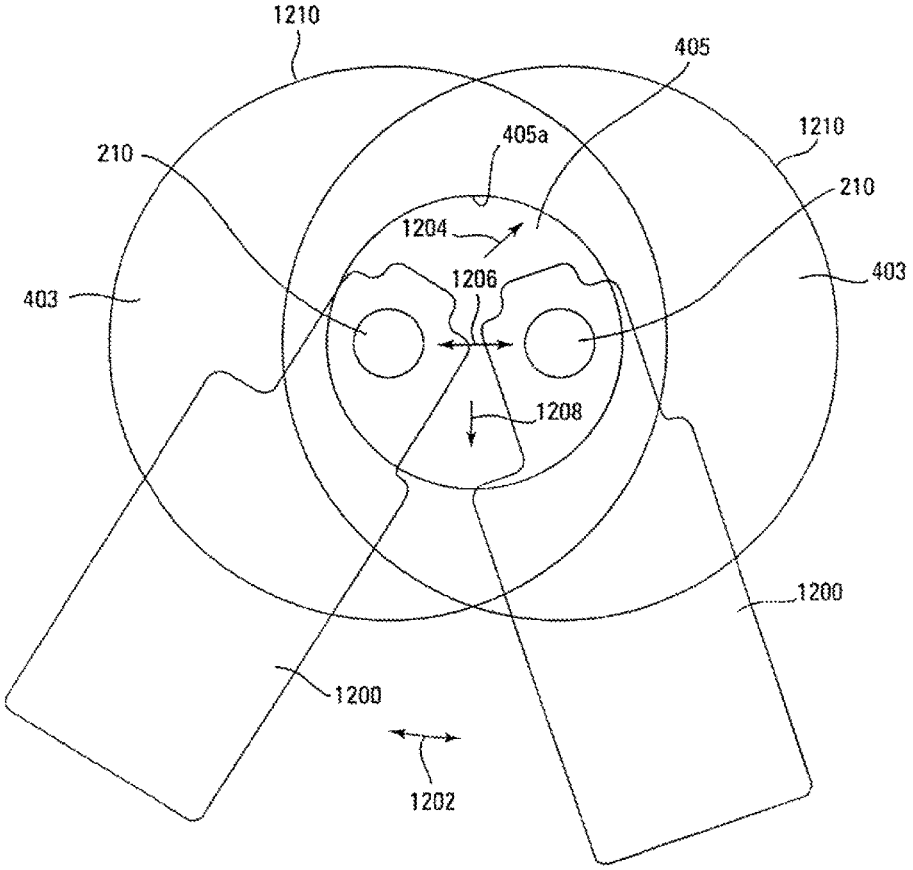
FIG. 18 is a schematic top plan view of an exemplary shuffler/shoe/base assembly mounted in a table aperture, illustrating range of motion of the shuffler with respect to the table.

In FIG. 18, the table aperture 405 is shown as circular in shape. The inner edges 405*a* define a range of motion of the shuffler 999 (FIG. 15) with integrated delivery shoe assembly 989 (FIG. 15), hereinafter a swivel mounted shuffler 1200.

The range of motion of the shuffler 1200 is limited by the size and shape of a horizontal cross-section of the external housing 210. In this example, the external housing 210 is tubular with an enclosed lower surface. The shuffler 1200 may be pivoted, for example, in an angular direction 1202, or may be moved linearly, for example, in directions 1204, 1206, 1208, while the exterior edges 1210 of mounting plate 403 (FIG. 17) cover stationary table aperture 405.

By providing a range of motion sufficient to compensate for the various sizes and preferences of dealers, the shuffler 1200 can be positioned on a table in a manner that optimizes dealer comfort, preventing repetitive motion injuries.

Dealers may wish to alter the position of the shuffler 1200 relative to the table at various intervals within a shift to relieve muscle stress and increase comfort.

A preferred structure includes a table with an aperture of a size sufficient to allow a maximum linear travel in any given direction to be about 8 inches, or more preferably about 6 inches. The motion may be linear, arcuate, angular, may have an X and Y component, and may be a combination thereof.

Since the position of the protective cover 210 is fixed relative to the swivel plate 403, the table aperture 405 remains concealed, unless the shuffler 1200 (FIG. 18) is removed completely from the table.

The importance of the overall height of the shuffler is significant from an ergonomic standpoint. Shufflers that provide a card insertion area at one end of the machine and a card output area at the opposite end must be low profile enough relative to the gaming surface to allow the dealer to reach over its upper surface on a repetitive basis. Lower profile shufflers are preferable because the lifting motion is reduced. By installing a card-imaging system 200 (FIG. 17) below the table top, the height of the shuffler is not significantly increased. This structure allows for the addition of card recognition to an existing shuffler "shuffler 999" of modular design, while maintaining a desirable low profile, and while incorporating features that enable ergonomic positioning on the table.

Preferably, the dimensions of the table aperture 405 provide the imaging system 200 (FIG. 5A) (which is preferably fixed with respect to the body of the shuffler 999 or delivery shoe assembly 989) with a significant degree of unrestricted movement within the table aperture 405, wherein the imaging system 200 can be repositioned within the table aperture 405 easily and safely. The protective external housing 210 provides ample protection for the imaging system 200. The combined shuffler 999/delivery shoe assembly 989/base 100 movement over the gaming table surface and the imaging system 200 range of motion within the table aperture 405 allows a dealer to maneuver and/or reposition a shuffler/shoe angle and or position on a gaming table surface relative to dealing a card game, wherein repositioning the shuffler/shoe provides a higher degree of comfort and ease when dealing a card game.

Figure 16:
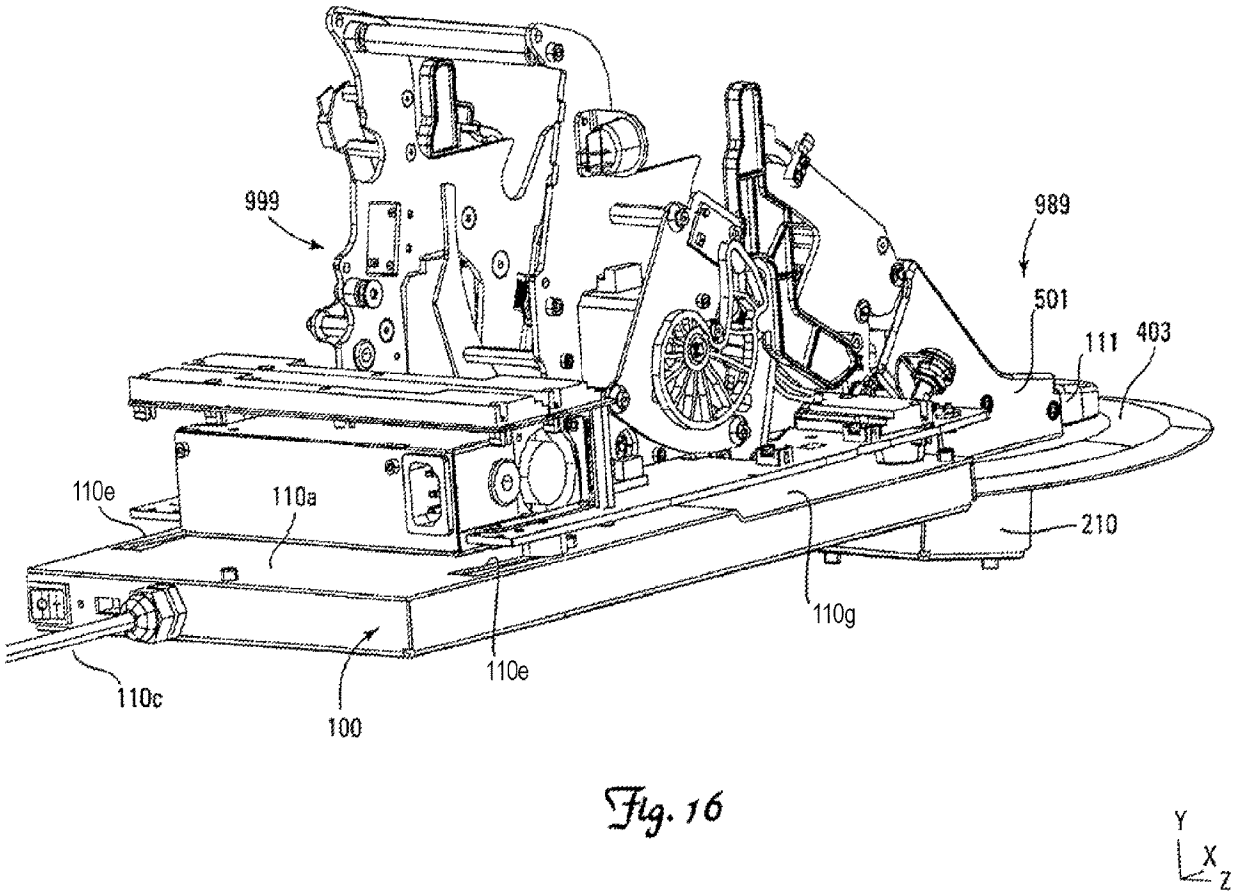
FIG. 16 is a rear perspective view of the shuffler/shoe assembly with shuffler exterior housing and carousel removed.

FIG. 16 shows a rear perspective view of the shuffler/shoe assembly with the cover and carousel removed. A delivery shoe main circuit board 110 (see FIG. 13) is positioned below first upper surface 110*a*. It is preferred that the first upper surface 110*a* of the main circuit board base 100 has two apertures 110*e* (FIG. 12), wherein the shuffler support posts 601*a* and 601*b* (FIG. 3) fit securely into the apertures 110*e*. The second upper surface 110*g* closest to the delivery shoe is preferably lower than first upper surface 110*a*. The vertical drop of the second upper surface 110*g* is approximately equal to the depth of aperture(s) 110*e* (FIG. 12). This configuration provides a stable and level support structure for shuffler 999 while attached to the base 100.

FIG. 15 shows a side elevational view of the shuffler 999 attached to the delivery shoe assembly 989 and its base 100, wherein the shuffler 999 appears level and stable mounted to the base. Preferably, the shuffler 999 is manually adjusted with respect to the table by physically rotating the shuffler structure horizontally clockwise and/or counterclockwise, wherein the shuffler structure's available range of motion is relative to the shuffler's immediate position on the table and/or the dimensions of the table aperture 405 formed by the distance between ends of the table aperture 405 (FIG. 17).

In one embodiment, the shoe main circuit board 110 (FIG. 13) has programmed game rules, wherein the shoe main circuit board 110 determines a game outcome based on the card rank and/or suit information transmitted by the FPGA/DSP hardware component(s) of the card-imaging system 200. Therefore, it is the shoe main circuit board 110 that transmits a game outcome (based on dealt card information) via I/O port 110*c*, (FIG. 13) to an operatively associated PC and/or external network. In other embodiments, game rules reside in an external game computer that communicates with the delivery shoe assembly 989 via I/O port 110*c*. The two-dimensional CMOS card data acquisition and associated FPGA processing is prior art and is disclosed and fully described in the related U.S. patent application Ser. No. 11/484,011, filed Jul. 7, 2006, now U.S. Pat. No. 7,933,448, issued Apr. 26, 2011. As with all references cited herein, this patent is incorporated herein by reference in its entirety.

Figure 11:
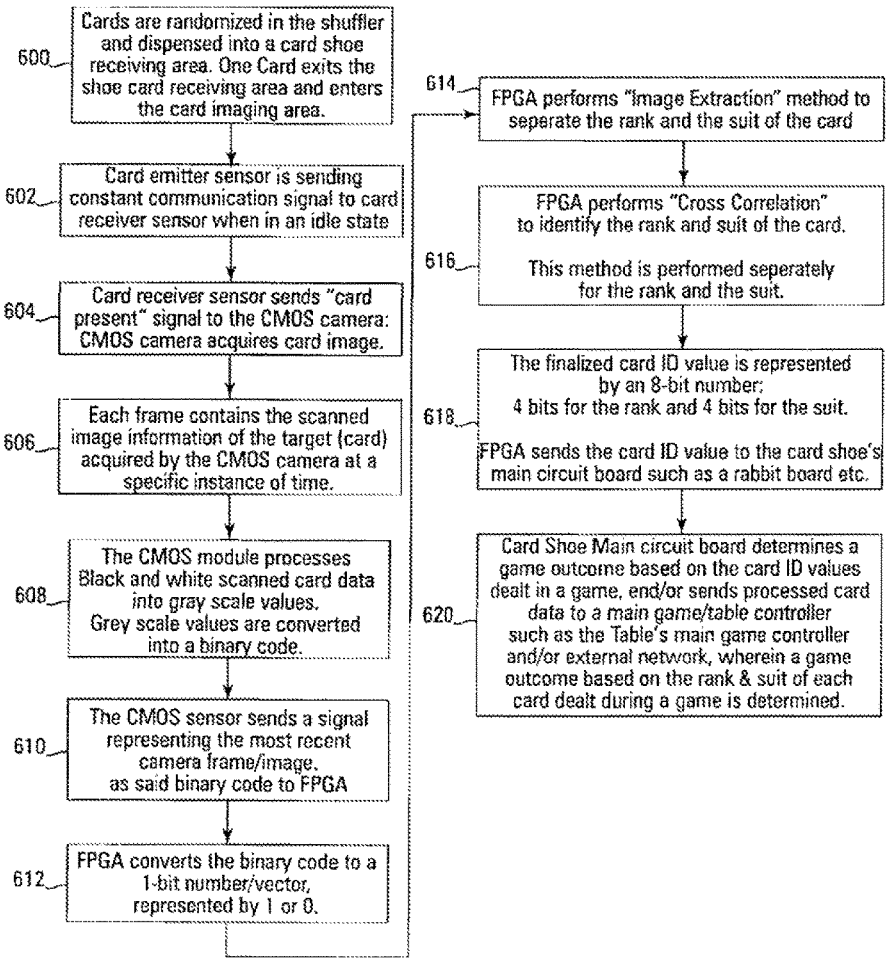
FIG. 11 is a flow diagram representing the card-imaging process.

FIG. 11 is a process flow diagram describing the process of imaging cards as they are randomized and move through the shoe.

In step 600, randomized groups of cards are pushed out of a compartment in the carousel 2 and into card-receiving area 119 of the delivery shoe assembly 989. The sliding block or card wedge 121 retracts to permit cards to move into a staging area. Prior to a first card being moved past the card-imaging system 200, the card emitter sensor sends a signal (step 602) to the receiver that no card is present in the sensing position (playing card 13 shown in FIG. 17).

When a single card is manually moved into a sensing position, the card receiver senses the presence of a card (step 604). Within the imaging area, data is captured (step 606) representative of a frame of image information. This information is acquired by the CMOS camera at time t.

Next, the CMOS module converts (step 608) the scanned card data into gray scale values. The gray scale data is sent to the FPGA (step 610) where it is converted into binary code (step 612).

An FPGA next performs image extraction (step 614) to differentiate between the rank and suit images. A cross-correlation (step 616) is performed to identify rank and suit. Rank and suit is determined separately.

The card rank and/or suit is determined and represented by an 8-bit number. The FPGA sends this data (step 618) to its associated processor or to an external game controller. The final step 620 is to determine game outcome using the card information and programmed game rules.

Although specific examples and specific materials and dimensions may be stated in descriptions to better enable practice of the present technology, those descriptions are intended to be non-limiting specifics enabling generic concepts in the practice of the invention. One skilled in the art would fully appreciate and being enabled from the present disclosure to use alternatives, substitutes and equivalents in the construction of the described technology, without creating a separate and distinct invention.

The invention claimed is:

1. An automatic card shuffler, comprising:

a card infeed area;

a card shuffling mechanism positioned to receive cards from the card infeed area;

a card unloader configured to remove cards from the card shuffling mechanism;

a bottom support member having a first portion supporting the card shuffling mechanism;

a card imaging system configured to detect at least one indicia on the cards, the card imaging system supported by the bottom support member;

a shoe coupled to the bottom support member and positioned to receive cards from the card unloader;

a processor programmed to convert signals from the card imaging system into at least one of rank or suit information of the cards; and a quick disconnect structure configured to removably couple the card shuffling mechanism to the shoe.

2. The automatic card shuffler of claim 1, wherein the processor is supported by the bottom support member.

3. The automatic card shuffler of claim 1, wherein the card shuffling mechanism comprises a plurality of card-storing compartments.

4. The automatic card shuffler of claim 3, wherein the card unloader is configured to transfer a group of cards from one compartment of the plurality of card-storing compartments of the card shuffling mechanism to the shoe.

5. The automatic card shuffler of claim 1, wherein the card shuffler is configured to transfer cards from the card shuffling mechanism to the shoe with the card unloader.

6. The automatic card shuffler of claim 1, wherein the card imaging system is positioned under a portion of the shoe.

7. The automatic card shuffler of claim 1, wherein the card imaging system comprises a camera and the processor, wherein the processor comprises an image-processing module.

8. The automatic card shuffler of claim 1, wherein the card imaging system is configured to scan each card individually removed from the shoe.

9. The automatic card shuffler of claim 1, wherein the card imaging system comprises a light board configured to illuminate the at least one indicia of the cards during imaging with the card imaging system.

10. An automatic card shuffler, comprising:

a card shuffling mechanism configured to randomize cards;

a shoe;

a lower support member coupled to the card shuffling mechanism with the card shuffling mechanism positioned over the lower support member, the shoe coupled to a portion of the lower support member and the lower support member configured to be placed on a surface of a gaming structure, the lower support member supporting a card imaging system configured to detect at least one indicia of the cards, the card imaging system positioned proximate a card output area of the shoe and configured to scan the cards dispensed from the shoe, wherein an upper portion of the shoe is positioned over the card imaging system; and a quick disconnect structure configured to removably couple the card shuffling mechanism to the lower support member in communication with the shoe.

11. The automatic card shuffler of claim 10, wherein the card imaging system comprises a camera and an image-processing module.

12. The automatic card shuffler of claim 11, wherein the card imaging system further comprises a light board configured to illuminate the at least one indicia of the cards during imaging with the camera.

13. The automatic card shuffler of claim 10, further comprising a processor, the processor configured to convert signals from the card imaging system into at least one of rank or suit information of the cards.

14. An automatic card shuffler, comprising:

a lower support member supporting a card imaging system configured to detect at least one indicia of cards;

a shoe portion coupled to the lower support member, the shoe portion defining a card path extending over the card imaging system for imaging the cards as the cards pass along the card path, wherein the shoe portion comprises a finger insertion opening in a front cover plate for removing cards from the shoe portion, the finger insertion opening being offset from a center of the shoe portion to define a first larger side of the front cover plate bordering the finger insertion opening on a first side, the first larger side having a relatively larger area as compared to a second smaller side of the front cover plate bordering the finger insertion opening on a second side, the first larger side overlying the card imaging system and completely overlying a camera of the card imaging system; and a card shuffling mechanism coupled to the lower support member and comprising a card infeed area configured to supply cards to the card shuffling mechanism and a card output area, wherein the shoe portion is positioned to receive shuffled cards from the card output area of the card shuffling mechanism.

15. The automatic card shuffler of claim 14, wherein the card imaging system comprises the camera and an image-processing module.

16. The automatic card shuffler of claim 15, wherein the camera and the image-processing module are mounted to the lower support member.

17. The automatic card shuffler of claim 16, wherein the card imaging system further comprises a light board mounted to the lower support member and configured to illuminate the at least one indicia of the shuffled cards during imaging with the camera.

18. The automatic card shuffler of claim 14, wherein the card shuffling mechanism comprises a plurality of card-storing compartments.

19. The automatic card shuffler of claim 18, further comprising a card unloader positioned and configured to transfer groups of cards from the plurality of card-storing compartments of the card shuffling mechanism to the shoe portion.

20. The automatic card shuffler of claim 14, wherein the card imaging system is positioned under the shoe portion.

* * * * *